US010744354B2

(12) United States Patent
Choate et al.

(10) Patent No.: US 10,744,354 B2
(45) Date of Patent: Aug. 18, 2020

(54) SEALED RETRACTABLE FALL ARREST BLOCK

(71) Applicant: Reliance Industries, LLC, Wheat Ridge, CO (US)

(72) Inventors: Gary E. Choate, Lakewood, CO (US); Dan Henn, Spring Branch, TX (US)

(73) Assignee: RELIANCE INDUSTRIES, LLC, Wheat Ridge, CO (US)

( * ) Notice: Subject to any disclaimer, the term of this patent is extended or adjusted under 35 U.S.C. 154(b) by 182 days.

(21) Appl. No.: 15/578,516

(22) PCT Filed: May 26, 2016

(86) PCT No.: PCT/US2016/034249
§ 371 (c)(1),
(2) Date: Nov. 30, 2017

(87) PCT Pub. No.: WO2016/196162
PCT Pub. Date: Dec. 8, 2016

(65) Prior Publication Data

US 2018/0161608 A1 Jun. 14, 2018

Related U.S. Application Data

(60) Provisional application No. 62/170,461, filed on Jun. 3, 2015.

(51) Int. Cl.
*A62B 35/04* (2006.01)
*A62B 35/00* (2006.01)

(52) U.S. Cl.
CPC ..... *A62B 35/0093* (2013.01); *A62B 35/04* (2013.01)

(58) Field of Classification Search
CPC ..... A62B 35/04; A62B 35/0093
See application file for complete search history.

(56) References Cited

U.S. PATENT DOCUMENTS 2,546,202 A * 3/1951 Trouin ..... A62B 35/0093 242/381.6
3,042,339 A * 7/1962 Gschwind ..... A62B 35/0093 242/381

(Continued)

OTHER PUBLICATIONS

International Search Report for corresponding PCT/US2016/034249, dated Nov. 10, 2016.

(Continued)

*Primary Examiner* — Colleen M Chavchavadze
(74) *Attorney, Agent, or Firm* — Sandberg Phoenix & von Gontard, P.C.

(57) ABSTRACT

A retractable fall arrest block comprising a spring side housing member and a drum side housing member. A center support wall, defining a bearing housing, is secured between the housing members. A bearing assembly is mounted in the bearing housing to support a spindle. A spring side housing member is mounted to a spring side of the center support wall and a spring side cover is mounted to the spring side housing member opposite the center support wall to define a spring housing. A drum side housing member is mounted to a drum side of the center support wall, and a drum side cover is mounted to the drum side housing member to define a drum housing. The spindle extends into both housings. A spring is mounted in the spring housing. A drum is positionally fixed to the spindle in the drum housing. A clutch assembly is mounted to the spindle to stop the drum from unwinding.

11 Claims, 24 Drawing Sheets

(56) References Cited

U.S. PATENT DOCUMENTS 3,760,910 A * 9/1973 Koshihara ..... A62B 35/0093 188/180
4,198,033 A * 4/1980 de la Messuziere ..... A62B 35/0093 182/241
5,351,906 A * 10/1994 Feathers ..... A62B 1/10 182/237
5,722,612 A * 3/1998 Feathers ..... A62B 35/0093 192/103 C
5,771,993 A 6/1998 Anderson et al.
5,829,548 A * 11/1998 Ostrobrod ..... E06O 7/18 182/18
7,281,620 B2 * 10/2007 Wolner ..... A62B 1/10 192/223.1
8,226,024 B2 * 7/2012 Meillet ..... A62B 1/08 242/377
8,528,694 B2 * 9/2013 Meillet ..... A62B 35/0093 182/3
8,567,562 B2 * 10/2013 Meillet ..... A62B 1/10 182/234
8,950,551 B2 * 2/2015 Jones ..... A62B 35/0093 182/231
8,991,556 B2 * 3/2015 Auston ..... A62B 35/0093 182/234
9,121,462 B2 * 9/2015 Casebolt ..... A62B 1/10
9,199,103 B2 * 12/2015 Hetrich ..... A62B 1/10
10,351,385 B2 * 7/2019 Choate ..... A62B 35/0093
10,413,761 B2 * 9/2019 Hetrich ..... A62B 35/0093
2010/0116922 A1 * 5/2010 Choate ..... A62B 35/04 242/384.7
2011/0220436 A1 * 9/2011 Green ..... A62B 35/0093 182/232
2011/0278095 A1 11/2011 Hetrich et al.
2012/0118670 A1 5/2012 Olson et al.
2013/0206510 A1 8/2013 Casebolt
2014/0239243 A1 8/2014 Anderson et al.
2016/0236018 A1 * 8/2016 Chen ..... A62B 35/0093
2018/0078795 A1 * 3/2018 Lin ..... A62B 35/04

OTHER PUBLICATIONS

Written Opinion for corresponding PCT/US2016/034249, dated Nov. 10, 2016.

* cited by examiner

SEALED RETRACTABLE FALL ARREST BLOCK

CROSS-REFERENCE TO RELATED APPLICATIONS

This application is the National Stage under 35 U.S.C. § 371 of International App. No. PCT/US2016/034249 which claims priority to U.S. App. No. 62/170,461 filed Jun. 3, 2015 which is entitled "Sealed Retractable Fall Arrest Block" and both of which are incorporated herein by reference.

STATEMENT REGARDING FEDERALLY SPONSORED RESEARCH OR DEVELOPMENT

Not Applicable.

BACKGROUND OF THE INVENTION

This application relates to fall arrest units, and, in particular to sealed component fall arrest units in which all the rotating components (i.e., return spring, drum, and clutch) are supported by a cantilevered main shaft or spindle rotatably mounted in the housing of the fall arrest unit so as to prevent the housing itself from bearing any substantial load. Further, the construction of the fall arrest unit allows for the entire working assembly to be easily accessed to facilitate replacement of worn, damaged, or non-functioning parts.

Retractable fall arrestors or lifelines have been used for many years and range in size from small (6 ft.) units to large (175 ft.) units. The purpose of a retractable lifeline or fall arrest unit is to allow workers, who must work on the leading edge of elevated surfaces (or other areas where falls are of concern) to have a means to attach to an anchorage that will arrest their motion in case of an accidental fall. These retractables are usually equipped with a 3/16" wire rope cable or a 1" webbing lanyard, currently, of at least 3600 lbs. of anchorage strength. The retractables are equipped with shock absorbers that will limit the forces of a falling worker to 900 lbs. or less during a fall arrest. These shock absorbers may comprise an internal mechanical clutch type or an external rip-stop type made of webbing. The internal clutch mechanisms usually comprise a stack of friction disks which are held under a known compressive force by preloaded Belleville springs. The internal clutch mechanism normally is activated by a centrifugal pawl mechanism only after the falling worker achieves a certain velocity. The advantage of a mechanical clutch type shock absorber over a webbing rip-stop type shock absorber is that the internal clutch mechanism will activate much more quickly with less free fall than the webbing rip-stop type shock absorber. The shorter free fall reduces input energy and generates a lower fall arrest force.

One of the difficulties of using mechanical retractable shock absorbing lifelines is that they must be periodically inspected for damage and be retested to confirm that they are operating correctly. This is usually done yearly and requires each fall arrest unit to be returned to the manufacturer for recertification. The reason these units must be returned to the manufacturer is because they are mechanically difficult to service due to the precision setting required on the clutch assembly and the difficulty of unloading and removing the power retraction springs, which may be over 100 ft. long. This is both costly and time consuming, requiring the customer to purchase extra units that can be rotated out of service for recertification on a regular schedule.

These problems are greatly compounded when retractable units are used in off-shore work sites where the retractables will be exposed to a salt (and thus, corrosive) atmosphere. In such conditions, the retractable must be serviced and recertified after approximately four months. Further, when a retractable is being serviced, it is out of commission for about two months.

BRIEF SUMMARY OF THE INVENTION

Briefly, a fall arrest unit is provided with a structural center support wall and spring side and cable side housing members mounted to opposite sides of the structural center support wall. The main shaft or spindle is rotatably mounted to the structural center support wall (approximately in the center thereof) in a manner that will prevent the housing itself from bearing any substantial load. This allows for the housing members to be made from lightweight materials (such as aluminum or plastic) which can be easily extruded. Further, the components are sealed components, which allows for the entire working assembly to be easily accessed, thereby facilitating replacement of worn, damaged, or non-functioning parts. By designing the retractable so that all the components are mounted to a cantilevered main shaft or spindle that is supported by a central rib or wall, all component sub-assemblies can be stocked by the customer and replaced in the field, greatly reducing cost and down time. Only the individual components and sub-assemblies are then required to be returned to the factory for service.

Briefly stated, the retractable fall arrest block comprises a structural center support wall and a bearing assembly mounted to the center support wall. A spindle is rotatably supported by the bearing assembly, and extends from opposite sides of the center support wall.

A spring side housing member is mounted to a spring side of the center support wall and a spring side cover plate is mounted to an end surface of the spring side housing member opposite the center support wall, such that the spring side housing member, the spring side plate, and the center support wall, in combination, define a spring housing. One or more springs are mounted in parallel in the spring housing to be connected between the spindle and the spring side housing member to cause rotation of the spindle in a winding direction after the spindle has been rotated in an unwinding direction.

A drum side housing member is mounted to the drum side of the center support wall. A drum side cover plate is mounted to an end surface of the drum side housing member opposite the center support wall; and the drum side cover plate, the drum side housing member and the center support wall, in combination, defining a drum housing.

A drum is mounted to the spindle and rotatably fixed to the spindle, such that the drum and the spindle rotate together. A cable is wound about the drum. The drum is rotatable in an unwinding direction in which the cable can be unwound from the drum and in a winding direction in which the cable is wound onto the drum.

A clutch assembly is also mounted to the spindle. The clutch assembly is operable to stop the drum from rotating in the unwinding direction.

In accordance with a first aspect of the retractable fall arrest block, neither the drum side cover nor the spring side cover include bearing assemblies which would support the spindle, such that substantially only the structural center support wall supports the spindle. Therefore, the structural central support wall will bear substantially all the forces from a fall. This allows for the spring side and drum side housing members to be made from lightweight materials, such as light weight metals or plastics. For example, the spring side and drum side housing members can be made from aluminum.

In accordance with this aspect, the center support wall defines an opening external of the housing which is adapted to receive a connector to operatively connect the housing to a support structure during use of the retractable fall arrest block.

According to another aspect, the housing members have identical cross-sections, and except for finishing operations to the housing members, the spring side housing member and the drum side housing member are substantially identical. This allows for the spring side and drum side housing members to be formed by extrusion. Thus different sized retractables (i.e., 100 ft., 130 ft., 150 ft., 175 ft., etc.) can be made by using housing members or extrusions of different lengths.

In accordance with another aspect of the retractable, the center support wall can be provided with at least two lobes which extend away from the walls of the housing members. The lobes are adapted to enable mounting of the retractable to a surface. For example, the lobes can include holes through which fasteners can extend to secure the retractable to standoffs mounted to a surface (such as a wall).

In accordance with an aspect of the retractable, the structural center support wall comprises a center mount plate and a front center plate (or wiper plate), which, in combination, define a bearing housing. A bearing assembly is mounted to at least one of the plates of the support wall between the plates and inside of the bearing housing. The center mount plate and front center plate define openings through which the spindle extends.

In accordance with an aspect of the retractable, a seal is provided to seal the bearing housing from the drum housing to substantially prevent contaminants from entering the bearing housing from the drum housing. This seal can, for example, be a wiper seal which surrounds the spindle.

In accordance with an aspect of the retractable, the retractable includes a clutch/pawl housing separate from the drum housing and into which the spindle extends and in which a clutch mechanism is contained. The clutch housing comprises the drum side cover plate and a clutch cover which is secured to the drum side cover plate. The retractable fall arrest further includes a clutch housing seal which separates the drum housing from the clutch housing to substantially prevent contaminants from entering the clutch housing from the drum housing. This seal can, for example, be a wiper seal which surrounds the spindle.

In accordance with an aspect of the retractable, the spring side cover plate and the drum side cover plate are secured to the housing members by means of fasteners (such as screws or bolts) which extend into fastener holes in the housing members. In one embodiment, the fasteners and the housing members are made from different metals. To protect against (or to reduce the effect of) galvanic oxidation, the retractable fall arrest block further includes a sacrificial anode associated with each fastener, and which is in contact with the housing member into which the fastener extends. The sacrificial anode, which, for example, can be zinc or magnesium (for aluminum and steel parts), provides cathodic protection to at least reduce the oxidation of the housing members, cover plates and fasteners.

In accordance with another aspect, the retractable fall arrest unit or block comprises a block housing and a bearing subassembly supported in the block housing. The bearing subassembly comprises:

a bearing housing comprised of a first bearing housing member and a second bearing housing member, at least the first bearing housing member defining an opening;

a bearing assembly mounted in the bearing housing to at least one of the first and second bearing housing members;

a spindle or shaft rotatably journaled in the bearing assembly to be rotatably supported in the block housing and extending through the opening in the first bearing wall; and a bearing seal surrounding the spindle proximate the opening in the first bearing wall to substantially seal the bearing wall opening.

The retractable also includes a clutch subassembly supported by the block housing; the clutch subassembly comprising:

a first clutch housing wall and a second clutch housing wall defining the sides/walls of a clutch housing; the first clutch housing wall facing the first bearing housing member and defining an opening aligned with the opening of the first bearing housing member; the spindle extending through the first clutch housing wall opening into the clutch housing;

a clutch assembly mounted in the clutch housing; the clutch assembly comprising a sperrad and a plurality of pivotable pawls; one of the sperrad and plurality of pivotable pawls being rotationally fixed relative to the spindle and the other of the sperrad and plurality of pivotable pawls being mounted in the clutch housing to rotate or orbit about the spindle as the spindle rotates; and a clutch seal surrounding the spindle proximate the opening in the first clutch wall to substantially seal the clutch wall opening.

Lastly, the retractable includes a drum operatively mounted on the spindle between the bearing first wall and the first clutch wall; the drum being rotationally fixed relative to the spindle such that the drum and the spindle rotate together; a cable wound about the drum; the block housing comprising an opening through which the cable extends.

The pawl/clutch housing of the fall arrest unit or retractable is a sealed sub-assembly, the outer wall of which is formed from a casting (such as an aluminum casting) and the inner wall of which is formed from the drum side plate (which covers the drum housing). The two walls of the pawl/clutch housing are sealed with O-rings. The pawls are mounted to the outer wall and are acted upon by the sperrad which is fixedly mounted to the rotatable shaft (to rotate with the shaft). The pawls are in contact with the tips of the sperrad teeth as the shaft (and hence, sperrad) rotates. When the sperrad reaches a predetermined centrifugal velocity, the pawls will engage the teeth on the sperrad to prevent further rotation of the sperrad, thereby stopping rotation of the shaft (and unwinding of the cable from the fall arrest unit). Both sides of the sperrad are covered with friction disks that are preset to a known normal force to create enough friction to stop the fall of a worker within a predetermined distance (such as 42") and without exceeding a predetermined load (such as 900 lbs.).

The clutch housing and bearing housing are sealed via the clutch seal and bearing seal, respectively, relative to the drum to substantially prevent contaminants from entering the clutch housing and bearing housing.

In accordance with an aspect of the retractable, the clutch subassembly is removably mounted to the block housing.

In accordance with an aspect of the retractable, the bearing subassembly is removably mounted in the retractable or block housing.

In accordance with an aspect of the retractable, the retractable or block housing comprises a block first housing member and a block second housing member. At least one of the bearing housing members defines a mounting portion to mount the bearing subassembly between the block first and second housing members, such that the block first and second housing members are on opposite sides of the bearing subassembly. The retractable fall arrest further includes a spring mounted between the spindle and the second housing member which is operable to cause rotation of the spindle, and hence rotation of the drum.

In accordance with an aspect of the retractable, the retractable comprises a center seal which seals the bearing housing, and therefore seals the spring housing from the drum area to substantially prevent contaminants in the drum area from entering the spring housing.

A method for assembling the sealed retractable fall arrest is also disclosed. The method comprises:

- providing an extrusion having a profile corresponding to a profile of the sealed retractable;
- cutting a cable side housing member of a desired axial length from the extrusion; the cable side housing member being of a sufficient axial length to receive a cable drum of a desired size;
- cutting a spring side housing of a desired axial length from the extrusion;
- forming a cable exit notch in the cable side housing;
- assembling the spring side housing member and the cable side housing member together with a center wall assembly positioned between the spring side member and the cable side housing member; the center wall support assembly comprising a center wall and a shaft rotatably mounted to the center wall; whereby a cable side of the shaft extends into the cable side housing member and a spring side of the shaft extends into the spring side housing member;
- mounting a spring assembly to the spring side of said shaft;
- mounting a spring housing cover to the spring side housing member to close the spring side housing member;
- mounting a cable drum to the cable side of the shaft;
- mounting a cable housing plate to the cable side housing member to close the cable side housing member;
- mounting a clutch assembly to the cable side of the shaft such that the clutch assembly is separated from the cable drum by said cable housing plate; and
- mounting a clutch cover assembly to said cable housing plate to enclose said clutch assembly.

The center wall assembly can be provided as a complete sub-assembly, or the method of assembling the sealed retractable fall arrest can include a step of assembling the center wall assembly, which comprises mounting the shaft to a center support wall for rotation relative to the center support wall. The step of mounting the shaft to the center support wall comprises mounting a bearing assembly to a first side of the center support wall and covering the bearing assembly with a center wiper plate, whereby said bearing assembly is sealingly enclosed by the wiper plate and the center support wall.

The step of assembling the spring side housing member and the cable side housing member together with the center wall assembly can be performed after the spring is mounted to said spring side of the shaft and after the cable drum is mounted to the cable side of the shaft.

The drum cover plate, the clutch assembly, and the clutch assembly cover can be secured to the cable side housing member as a complete clutch sub-assembly.

To enable the housing members to be assembled with the center wall support assembly, the method includes forming axially extending fastener bores in end faces of the housing members prior to assembling the housing members to the center wall assembly.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
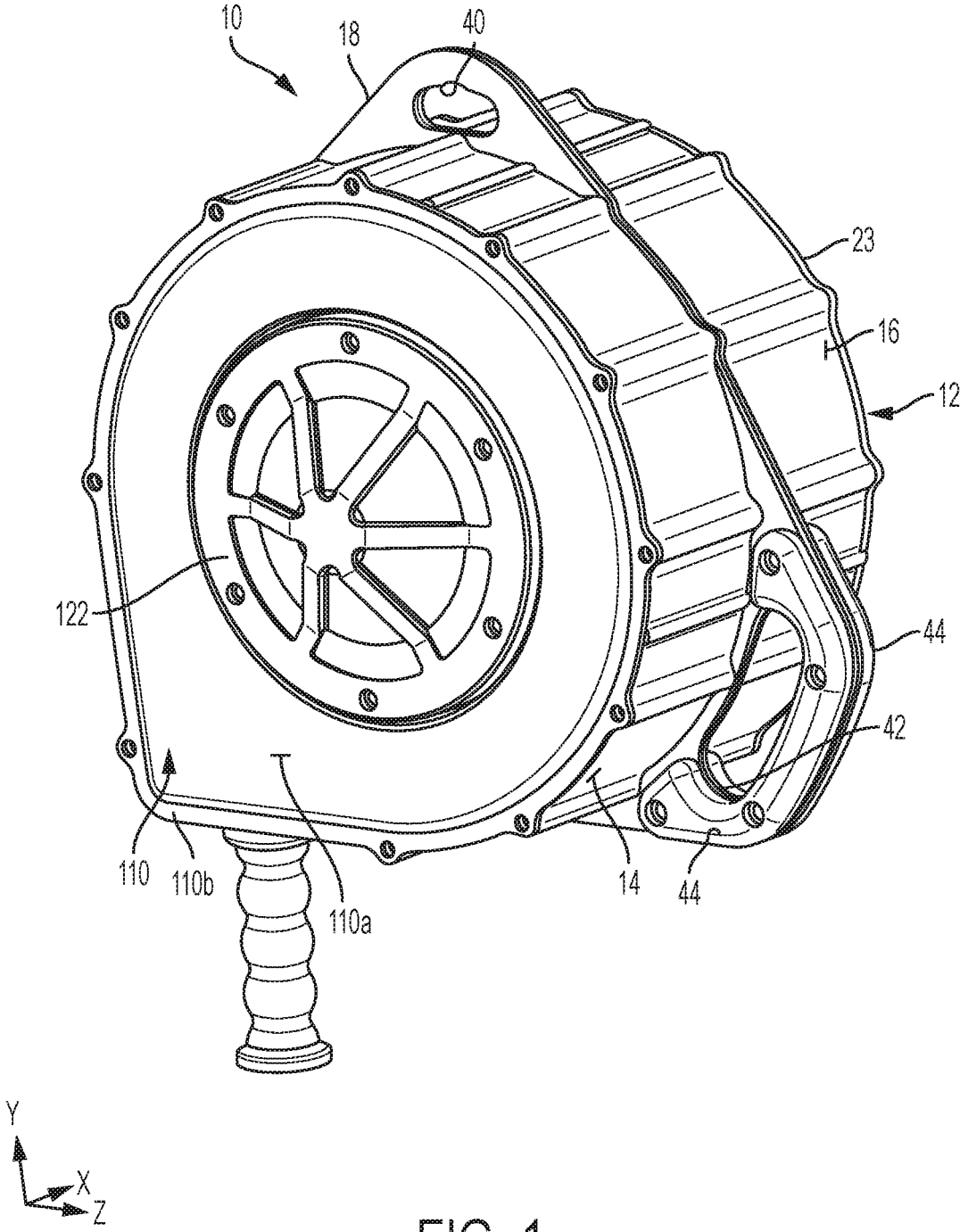
FIG. 1 is a perspective view of the sealed retractable fall arrest block or unit.

The following detailed description illustrates the claimed invention by way of example and not by way of limitation. This description will clearly enable one skilled in the art to make and use the claimed invention, and describes several embodiments, adaptations, variations, alternatives and uses of the claimed invention, including what is presently believed to be the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

A sealed retractable fall arrest unit or block 10 ("block" or "sealed block" or "sealed retractable") is shown generally in FIG. 1. The block 10 comprises a housing 12 formed of a cable side housing member 14 and a spring side housing member 16 mounted on a center support wall 18. The cable side housing member 14 is closed by a cover plate 110 and a clutch cover 122; and the spring side housing is closed by a spring housing plate 23.

Figure 4A:
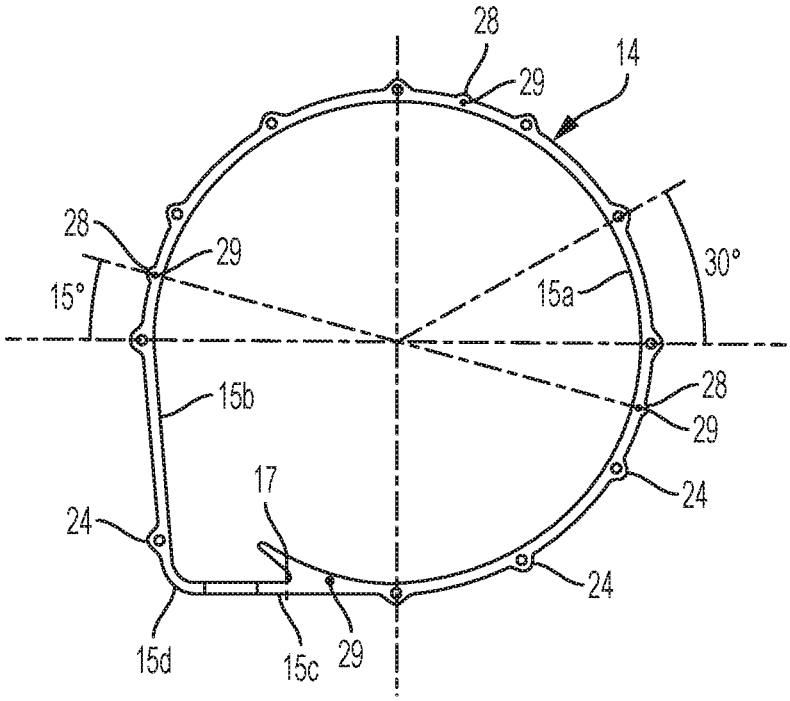
FIG. 4A is a plan view of a cable side housing of the sealed retractable fall arrest block, the retractable fall arrest block also including a spring side housing which is substantially identical to the cable side housing.
Figure 4B:
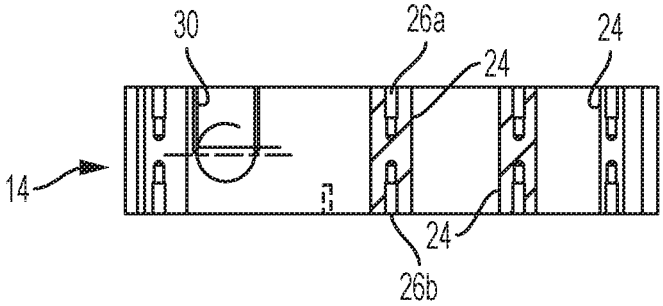
FIG. 4B is a side elevational view, partly in cross-section, of the cable side housing.

The housing members 14 and 16 are identical in end view. As seen in FIG. 4, the housing members each comprise a curved wall portion 15*a* defining an arc of a circle. The curved portion of the housing members can define an arc of about 270° to about 280°. Generally straight wall portions 15*b* and 15*c* extend from the ends of the curved wall portion 15*a* and join at an apex 15*d*. This gives the housing members a generally tear-drop shaped appearance. Internally, the housing members 14, 16 each include a projection 17 which continues the curvature of the curved wall portion 15*a* and extends over the straight wall portion 15*c*. Externally, the housing members each include a plurality of first ribs 24 which are evenly spaced about the curved wall portion 15*a*. A further first rib 24 is formed on the straight wall portion 15*b* proximate the apex 15*d*. The first ribs extend between the inner and outer surfaces of the housing members. Additionally, the housing members 14, 16 each have second ribs 28 which are smaller than the first ribs 24. The second ribs 28, like the first ribs 24, extend between the upper and lower surfaces of the housing members.

Figure 4C:
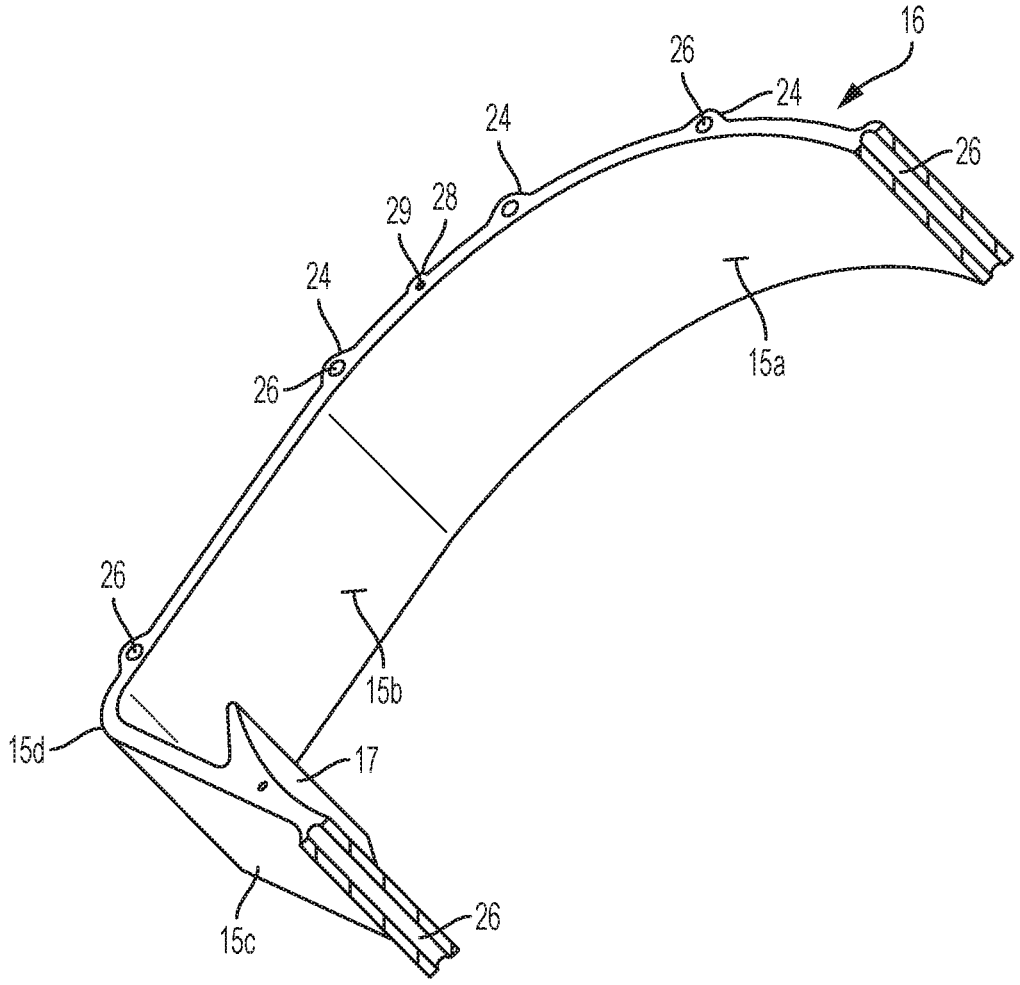
FIG. 4C is a perspective cross-sectional view of the spring side housing.

By way of definition, "inner end surface" corresponds to the surfaces of the two housing members which are proximate each other in the assembled block, and "outer end surface" corresponds to the surfaces of the housing members remote from the center support wall and to which the respective cover plates are secured. In the cable side housing member 14, upper bolt holes 26*a* and lower bolt holes 26*b* extend into the first ribs 24 from the inner and outer end surfaces, respectively. In the spring side housing member 16, bolt holes 26 extend through the first ribs 24, from the inner end surface to the outer end surface of the spring side housing member, as seen in FIG. 4C. The bolt holes could alternatively be formed such that the bolt holes in the cable side housing member extend the axial length of the cable side housing member and the spring side housing member is provided with blind bores. Additionally, both the spring side and cable side housing members have second bolt holes 29 extending from the outer end surfaces of the housings. Three second ribs 28 are shown, and are spaced apart by about 90°. A fourth bolt hole 29 is shown near the root of the projection 17, such that the four bolt holes 29 define two pair of bolt holes, wherein the holes of each pair of holes are about 180° from each other. Finally, the cable side housing member 14 has a notch 30 extending inwardly from the inner end surface of the straight wall 15*c*. As will be described below, this notch receives a nozzle.

Except for certain post formation finishing details (the nozzle notch 30 and the bolt holes 26 vs. 26*a,b*) and a potential difference in axial width, the two housing members are identical. That is, prior to post formation finishing, the two housing members are identical in cross-section. Further, the walls are consistent in their shape in a longitudinal direction. Thus, the cable side and spring side housing members can, for example, be extruded and can be cut from the same extrusion. The use of extruded housing members also avoids the potential of defects which are inherent in casting the housing members from sand casts. In sand casts, the molten metal is poured into the cast, and thus, air bubbles could form in the cast part. In addition, defects can result due to the status of the sand (i.e., green sand) used to form the mold. As will be explained below, the housing members bear substantially no loads, and therefore can be made from aluminum, plastics, or other lightweight materials. Because the two housing portions are extruded and (except for certain finishing details) are identical, the housings can be formed to desired sizes. Thus, the same housing extrusion can be used to form different size retractables (i.e., 100', 150', etc.).

Figure 2:
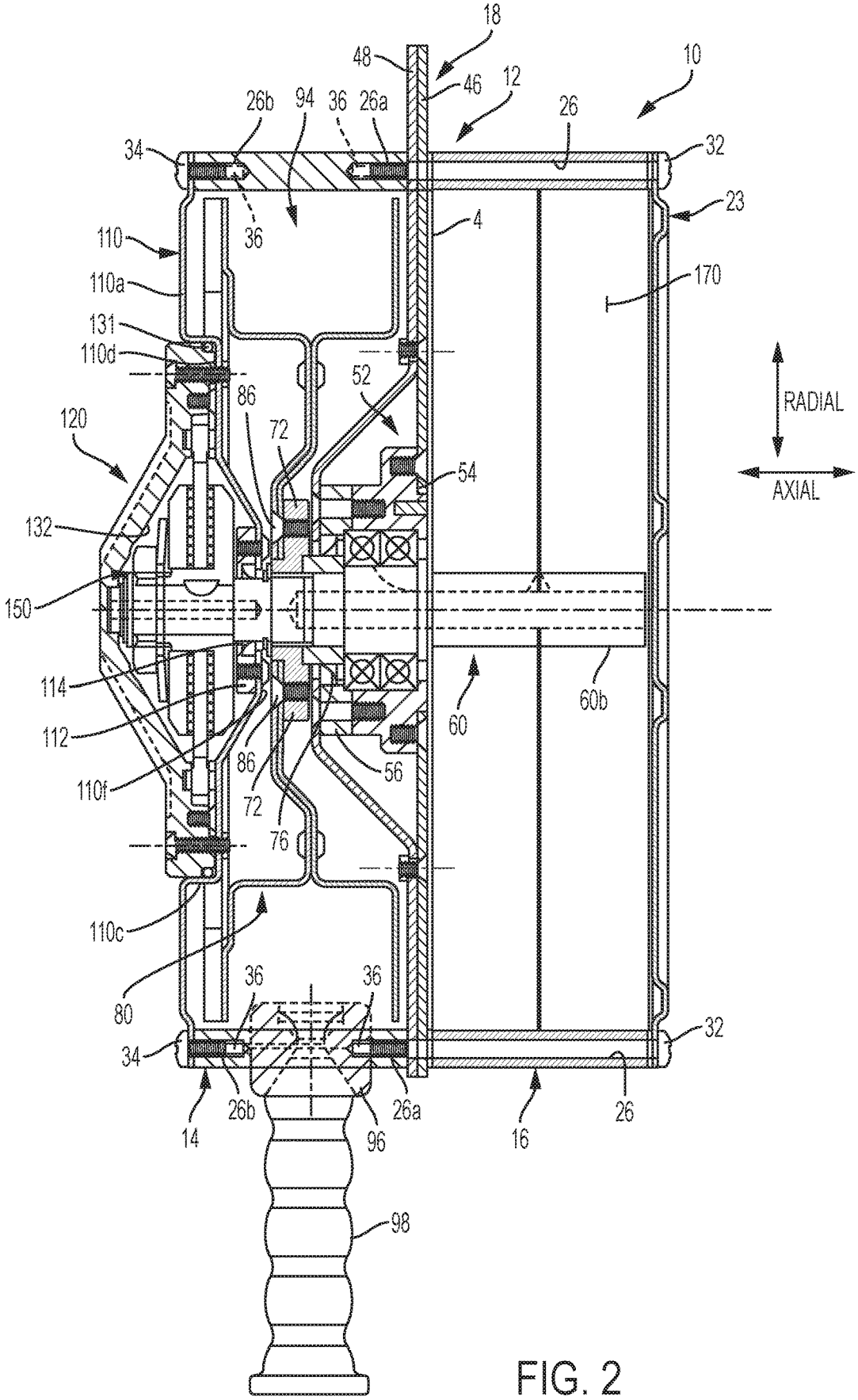
FIG. 2 is a cross-sectional view of the sealed retractable fall arrest block.
Figure 3:
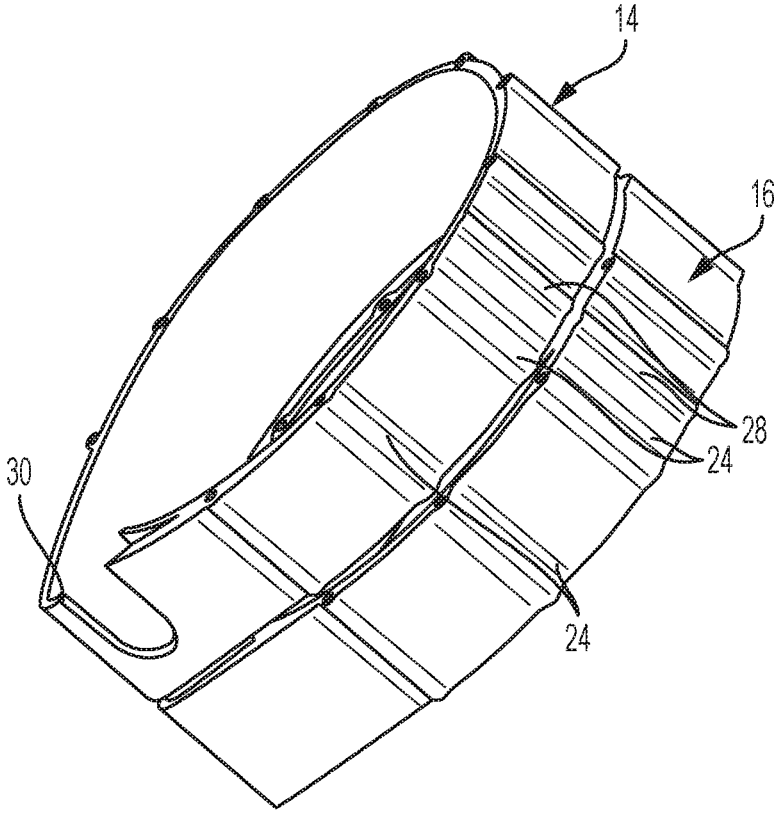
FIG. 3 is a perspective view of housing members for the sealed retractable fall arrest block.

Referring to FIG. 2, the housing 12 is assembled together by means of bolts 32 which extend through bolt holes in the spring cover plate 23 and through the bolt holes 26 of the spring side housing member 16, through the center support wall 18, and into the inner bolt holes 26*a* of the cable side housing member 14. Similarly, bolts 34 extend through the cable side cover plate 110 into the bolt holes 26*b* on the outer edge of the cable side housing member 14 to hold the cover plate 110 to the housing. As seen in FIG. 2, the bolt holes 26*a,b* are longer or deeper than the threaded shafts of the bolts 32, 34. The bolts 32, 34 thus do not extend to the ends of the bolt holes 26*a,b*. The cover plates 110, 23 and the bolts 32, 34 are, for example, made of stainless steel, and the housing members 14, 16 are, for example, made from aluminum. To reduce the corrosion of the housing members 14, 16, the cover plates 110, 23 and the bolts 32, 34, sacrificial anodes 36 are placed in the bolt holes 26*a,b* prior to threading the bolts 32, 34 into the bolt holes. The anodes 36 are preferably made of zinc wire (and preferable from pure zinc wire), but could be made of magnesium as well. As can be appreciated, the sacrificial anodes 36 provide cathodic protection to reduce (or preferably prevent) the oxidation of the housing members, cover plates and bolts which would occur between the aluminum and stainless steel components. If the housing members were made from plastic or other non-conductive materials, the sacrificial anodes would not be necessary.

As will become more apparent, all the elements of the sealed retractable are mounted to, or effectively mounted to, the center support wall 18, and the center support wall 18 bears all the forces from a fall. Thus, the cable side housing member and the spring side housing member bear substantially no forces from a fall. As seen by comparing FIGS. 6 and 7 to FIGS. 1 and 2, the center support wall 18 extends between the cable side and spring side housing members to separate the spaces defined by the two housing members, and have a perimeter which, in part, corresponds to the perimeter of the housing members. In addition, the center support wall 18 extends beyond the housing at a top portion of the sealed block to define an opening 40 to accept a connector (such as a carabineer) to secure the sealed block 10 to a support. The center support wall defines a second opening 42 which is outside the perimeter of the housing members 14, 16 to define a handle opening. Handle pieces 44 (FIG. 1) are secured to opposite sides of the center support wall 18 around the handle opening 42 to provide for a contoured handle for the sealed block 10.

Figure 5:
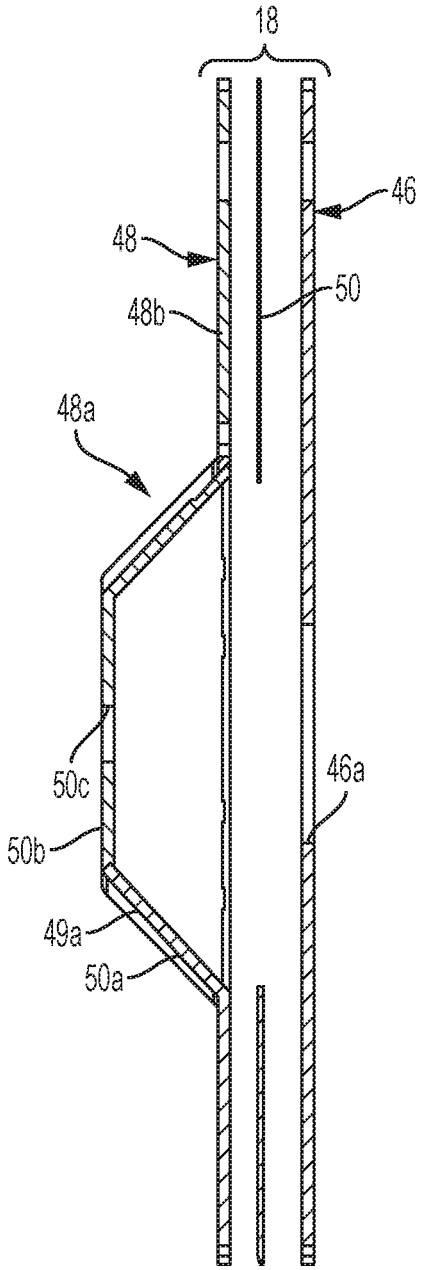
FIG. 5 is an exploded cross-sectional view of the structural center support wall of the sealed retractable fall arrest block.
Figure 6:
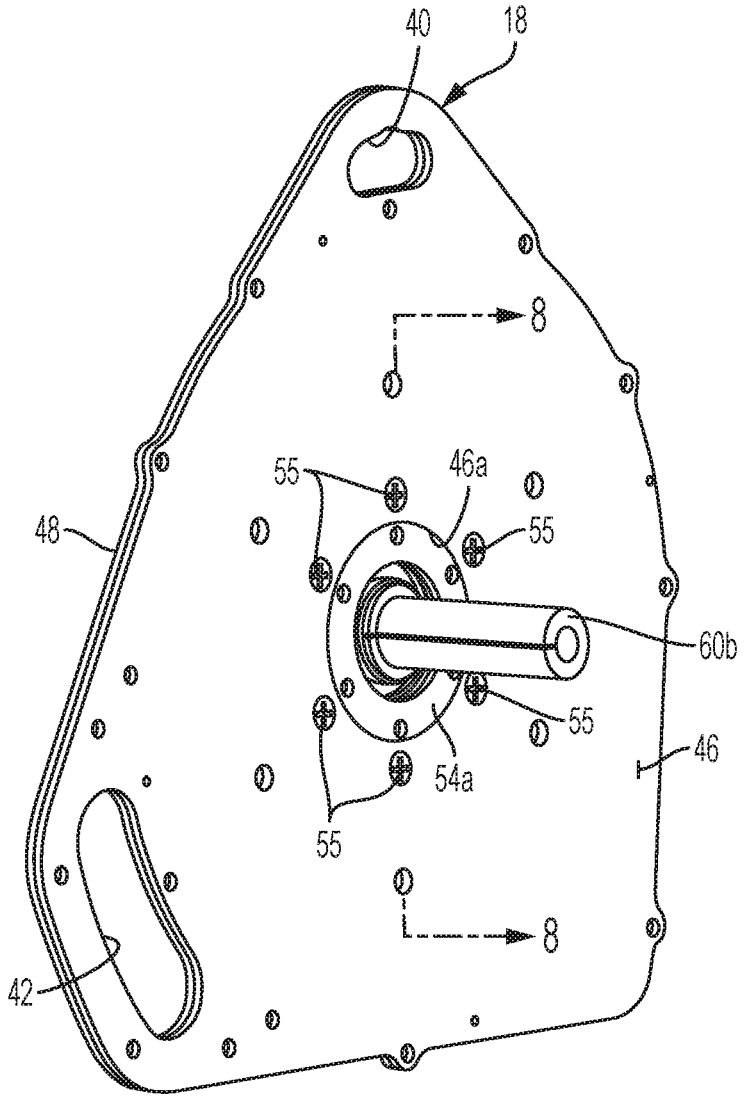
FIG. 6 is a spring side perspective view of a bearing-spindle sub-assembly, showing the spindle extending from a center mounting plate of the center support wall.
Figure 7:
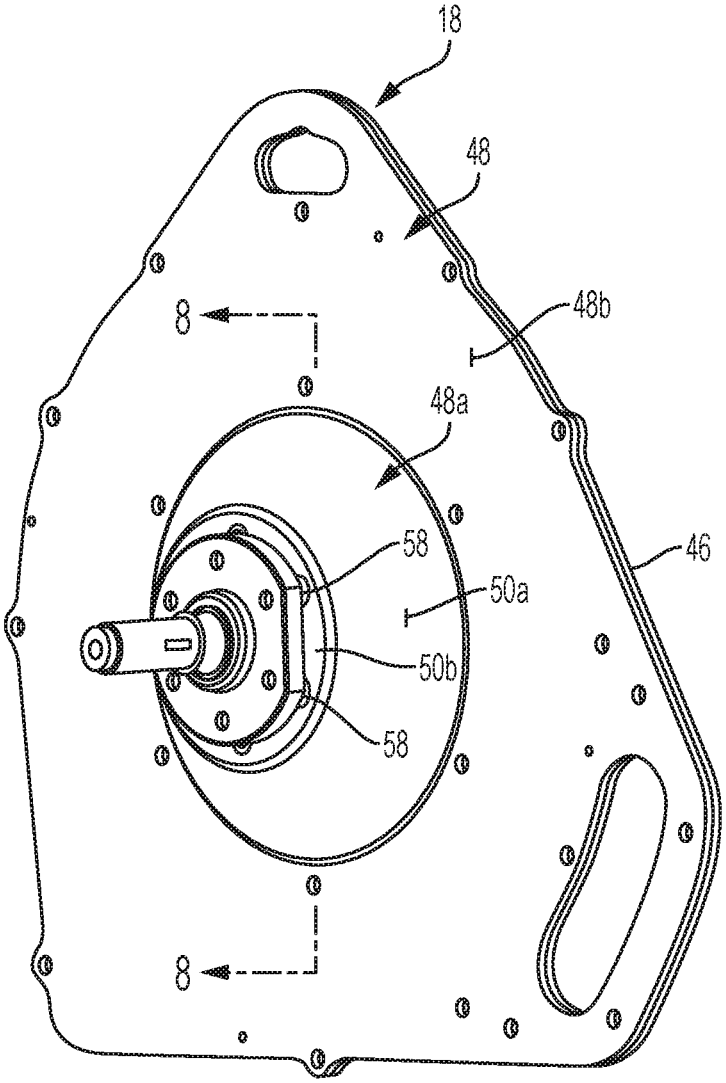
FIG. 7 is a cable side perspective view of the bearing-spindle sub-assembly, showing the spindle extending from a center wiper plate of the center support wall.

The center support wall 18 comprises a center mounting plate 46 and a center wiper plate 48. (FIG. 5) A center gasket 50 is positioned between the plates 46 and 48, and a second gasket can be positioned on the spring side of the center mounting plate 46. The center mounting plate 46 is generally flat, as best seen in FIG. 5 and defines a central opening 46*a*. The center wiper plate 48 comprises a truncated conical central portion 48*a* surrounded by a flat peripheral portion 48*b*. The truncated conical portion 48*a* comprises an inwardly sloping, generally circular wall 50*a* having a flat surface 50*b*. An opening 50*c*, concentric with the center plate opening 46*a*, is formed in the center of the surface 50*b*. The center mounting plate 46 and the truncated conical portion 48*a* of the center wiper plate 48 in combination define a bearing housing 52. (FIG. 8).

Figure 8:
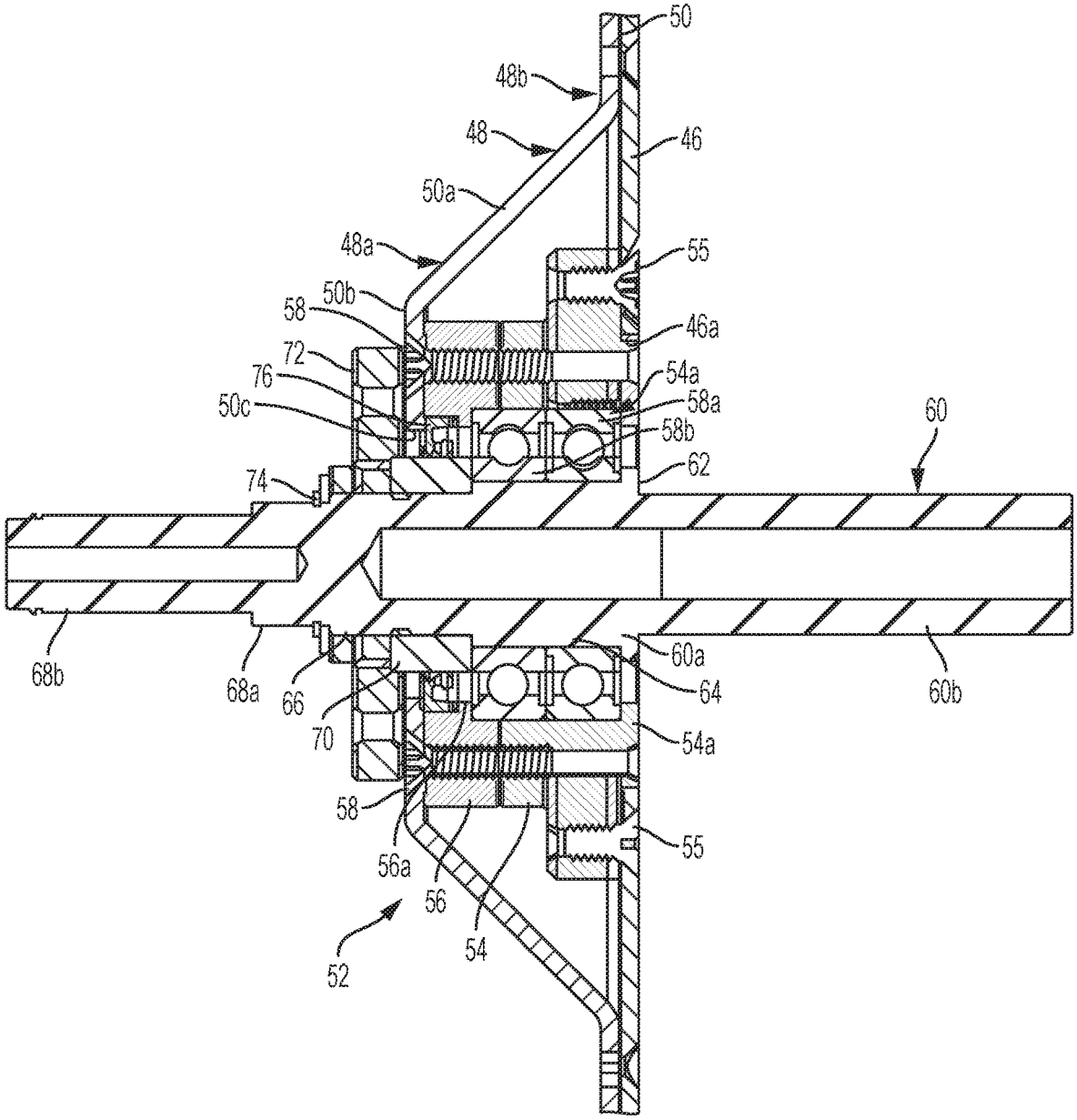
FIG. 8 is an enlarged cross-sectional view taken along line 8-8 of FIGS. 6 and 7 of the bearing-spindle sub-assembly.
Figure 10:
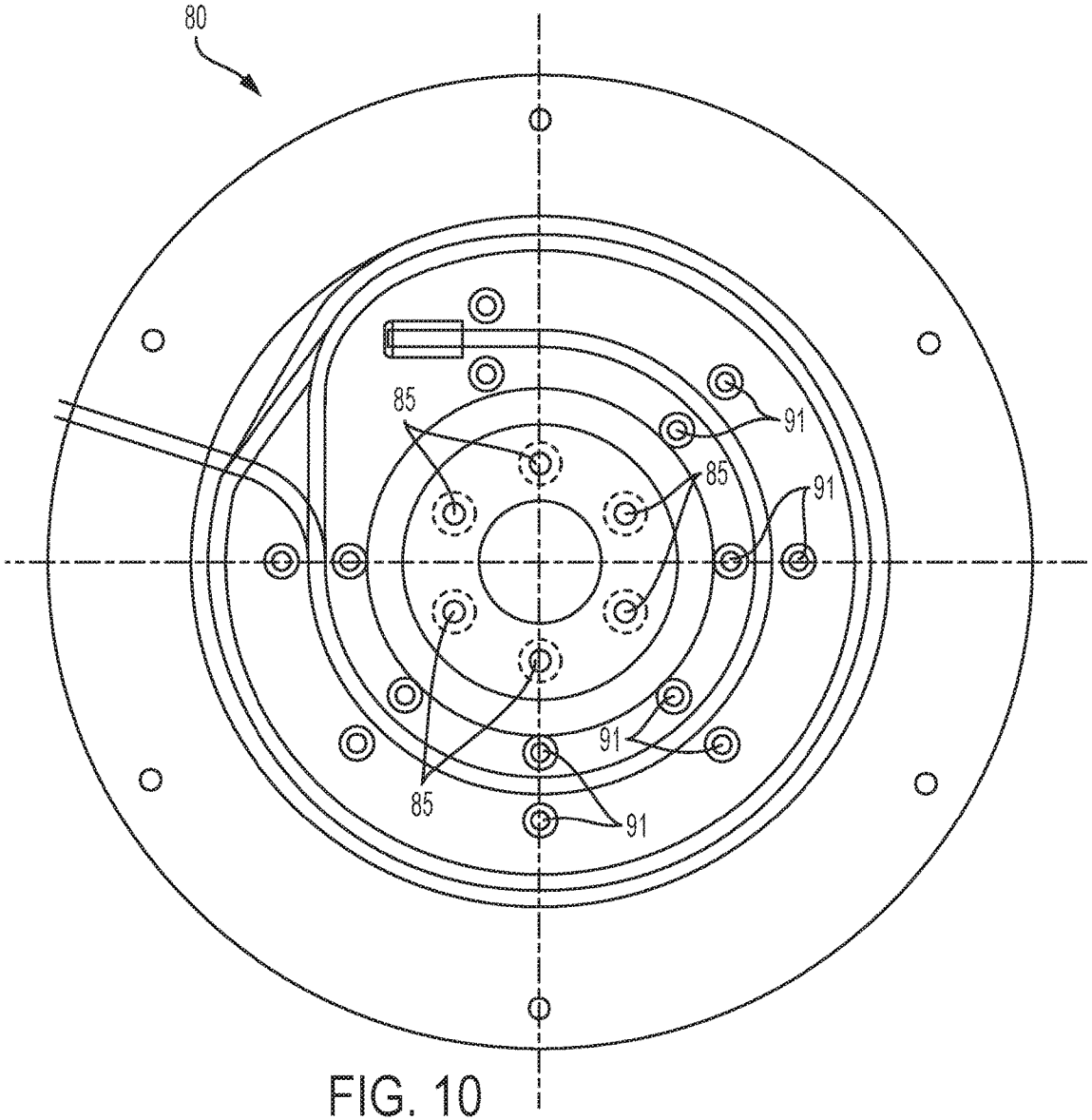
FIG. 10 is a back plan view of the drum assembly.

Turning to FIG. 8, within the bearing housing 52, an annular bearing holder 54 is mounted to the center mounting plate 46. The bearing holder 54 has a central positioning projection 54*a* which is received within the opening 46*a* of the center mounting plate 46. The bearing holder is secured to the center mounting plate by screws 55 which extend through the center mounting plate and into the bearing holder. An annular bearing plate 56 is positioned on a surface of the bearing holder 54 opposite the center mounting plate 46. The bearing holder 54 and the bearing plate 56 sandwich and hold in place a pair of ball bearing assemblies 58*a,b* which are stacked. The bearing holder 54 defines a bearing seat 54*a* on which the bearings sit; and the bearing plate 56 includes an inwardly extending flange 56*a* which extends slightly over the bearing assemblies, such that the bearing assemblies are sandwiched by the bearing seat 54*a* and the bearing plate flange 56*a*. Screws 58 extend through the top surface 50*b* of the central truncated conical portion 48*a* through the bearing plate 56 and into the bearing holder 54. As can be appreciated, the screws 55 and 58 serve to hold the bearing housing 52 together. Additional screws (not shown) extend through aligned screw holes in the peripheral flat portions of the center wiper plate and the center mounting plate.

A shaft or spindle 60 is rotatably journaled through the bearings 58*a,b* to be rotatable relative to the center support wall 18. The spindle 60 includes a central portion 60*a* positioned within the bearing housing 52, a spring portion 60*b* which extends from the center mounting plate 46 into the spring side housing member 16, and a cable/clutch portion 60*c* which extends from the wiper mounting plate 48 into the cable side housing member 14. The spindle includes a flange 62 between the central and spring portions 60*a,b* of the spindle. Forward of the flange, the spindle includes bearing section 64 which is journaled in the stacked bearing assemblies. The spindle steps down after the bearing section 65 to form a first forward portion 66 which extends through the opening 50*c* in the center wiper plate 48. The spindle steps down two more times, as at 68*a* and 68*b*. A spacer 70 is fixed (at least axially) to the spindle and has an end in engagement with the bearing assemblies, such that the bearing assemblies are sandwiched between the positionally (axially) fixed spacer 70 and the flange 62 of the spindle. As can be appreciated, the spacer 70 and the spindle flange 62 prevent the spindle 60 from moving axially relative to the bearing assemblies. This locks the inner races of the two bearings 58*a,b* together to control axial thrust. As noted in FIG. 2, an axial direction is generally parallel to an axis of the spindle 60. The spacer 70 extends through the wiper plate opening 50*c*. A drum bracket 72 is positioned on the spindle to sit on the outer surface of the spacer and to extend over the outer surface 50*b* of the truncated conical portion 48*a* of the center wiper plate. The drum bracket 72 is fixed axially relative to the spindle using, for example, a snap ring 74. Preferably, the drum bracket 72 is threaded to the spindle using left hand threads which tighten under load. The snap ring prevents back winding of the drum bracket relative to the spindle. The drum bracket 72 is also rotationally fixed relative to the spindle, so that it will rotate with the spindle. Lastly, a wiper seal 76 sits on the bearing plate flange 56*a* and engages a side surface of the spacer 70 to seal the opening 50*c* in the surface 50*b* of the center wiper plate 48. The wiper seal 76 effectively seals the bearing housing, and prevents contaminants from entering the bearing housing through the opening 50*c* to help reduce fouling of the bearings 58*a,b*.

Figure 9:
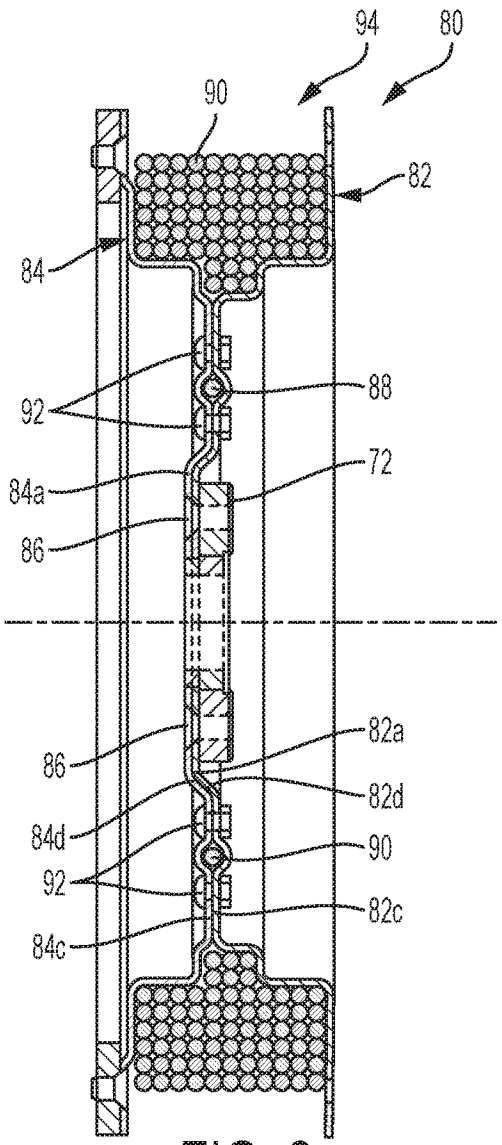
FIG. 9 is a cross-sectional view of a drum assembly of the sealed retractable fall arrest block.
Figure 11:
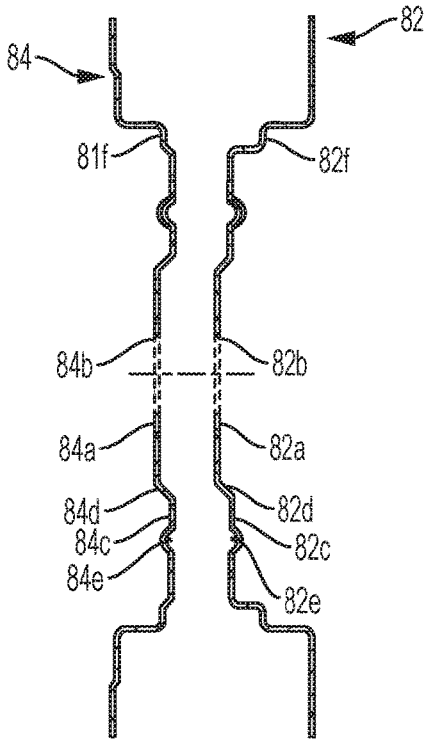
FIG. 11 is an exploded view of the drum of the drum assembly.
Figure 12A:
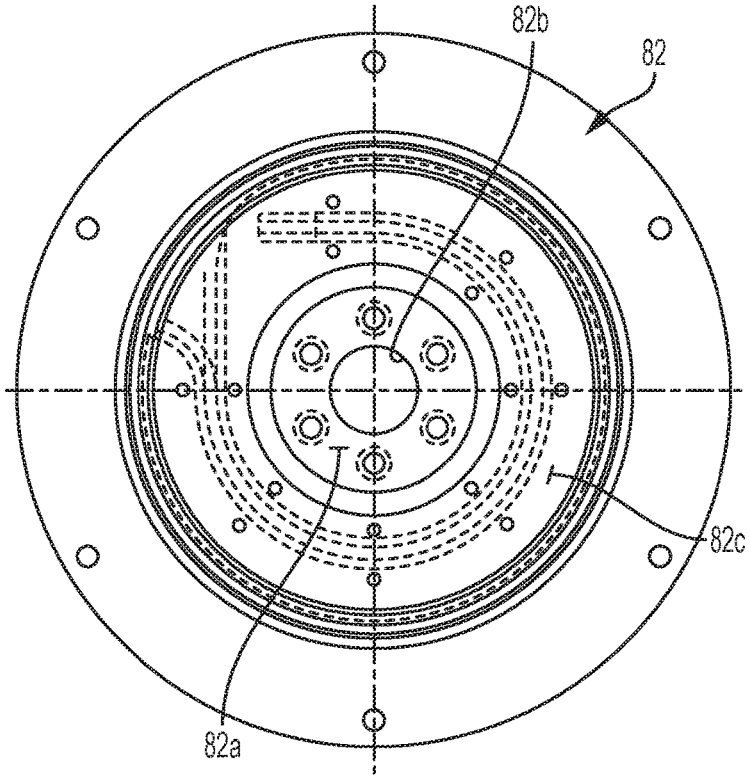
FIGS. 12A and 12B are plan views of the drum front and drum back, respectively.
Figure 12B:
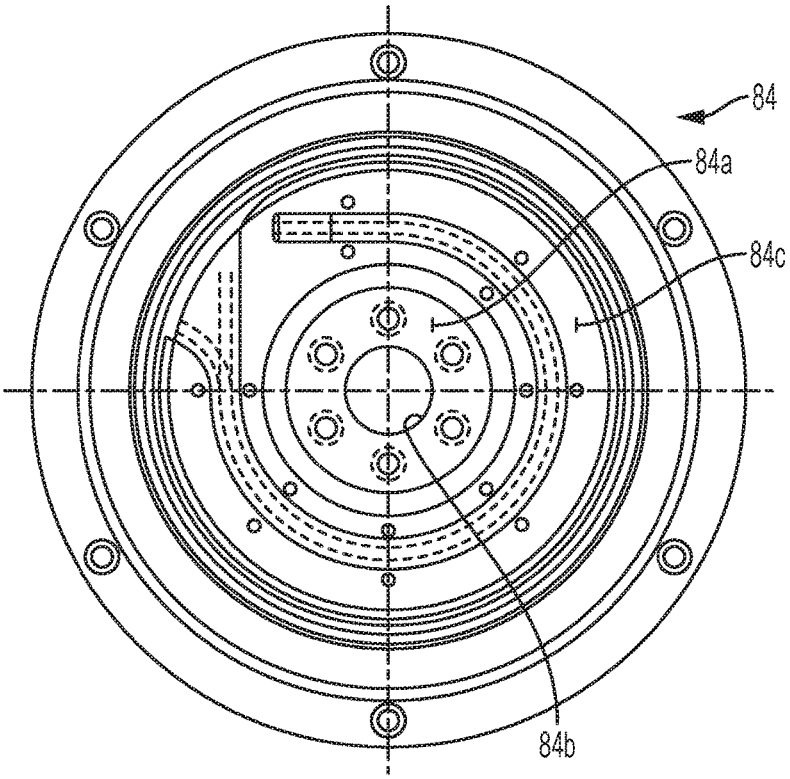

A drum assembly 80 (FIGS. 2 and 9-12B) is mounted to the spindle 60 adjacent the drum bracket 72. The drum assembly 80 comprises a back drum portion 82 and a drum front portion 84. The drum portions 82, 84 each comprise a generally flat central plate 82*a*, 84*a* defining a central opening 82*b*, 84*b* sized to fit over the spindle 60. The central plates 82*a*, 84*a* define a series of screw holes 85 around the central openings which receive fasteners (bolts or screws) 86 (FIG. 9) which extend through the central plates 82*a*, 84*a* and into screw holes in the drum bracket 72. The drum is thus rotationally fixed to the drum bracket, which in turn is rotationally fixed to the spindle.

The central plates 82*a*, 84*a* are each surrounded by an annular ring portion 82*c*, 84*c* which is off set from the plane of the central plate in the same direction, such that the annular ring portions 82*c*, 84*c* are adjacent each other in the assembled drum assembly 80. The annular ring portions 82*c*, 84*c* are connected to the central plates 82*a*, 84*a* by means of a sloping annular surface 82*d*, 84*d*. Oppositely directed and aligned channels 82*e*, 84*e* are formed in the ring portions 82*c*, 84*c*, and in combination, define a passage 88 which receives an end of the cable 90. Aligned screw holes 91 are formed in the annular portions 82*c*, 84*c* on either side of the channels 82*e*, 84*e* to receive screws or rivets 92 which secure the drum portions together and grip the cable 90. At the ends of the annular portions 82*c*, 84*c*, the drum portions expand away from each other, as at 82*f*, 84*f*, and in combination form a generally u-shaped annular portion 94. The cable gripping passage 88 opens into the u-shaped annular portion 94 to enable the cable 90 to be coiled into the annular portion 94. With reference to FIG. 2, the cable (not shown in FIG. 2) will extend from the drum through a nozzle 96 secured in the nozzle opening 30 of the cable side housing member 14 and through a cable stop handle 98. This handle is shaped with valleys and ridges (i.e., corrugated) so that it can compress easily to act as an energy absorber in case a cable is accidentally released when fully extended and allowed to return to under full spring retraction force. A connector or clip (not shown) is secured to the end of the cable to enable the cable to be secured to a safety vest. The cable stop handle 98 spaces the clip from the housing when the cable is fully retracted, and provides a convenient handle or grip for the cable.

Figure 13:
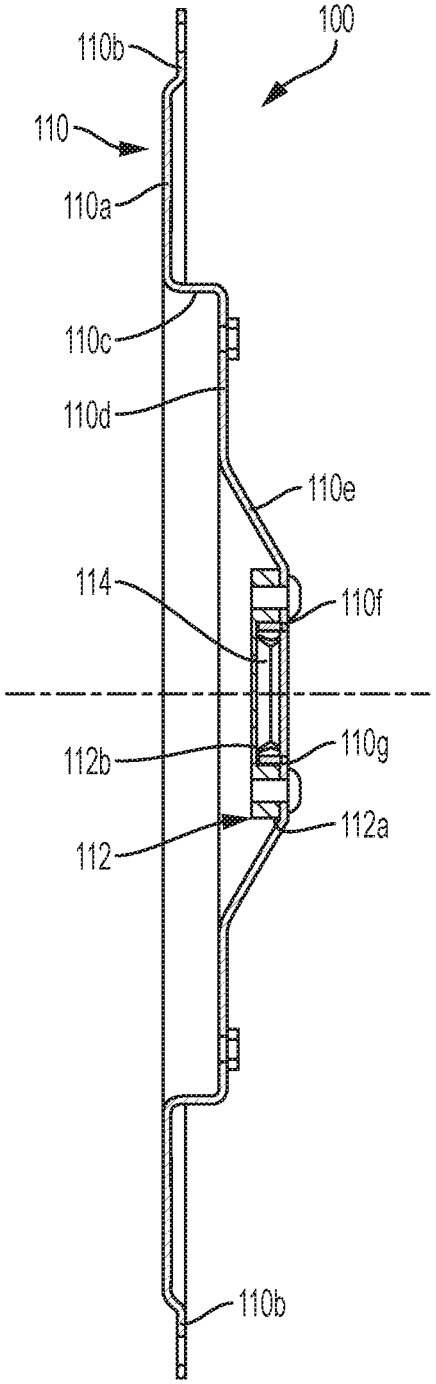
FIG. 13 is a cross-sectional view of a cable or drum cover plate sub-assembly which closes the drum housing of the sealed retractable fall arrest block.
Figure 14:
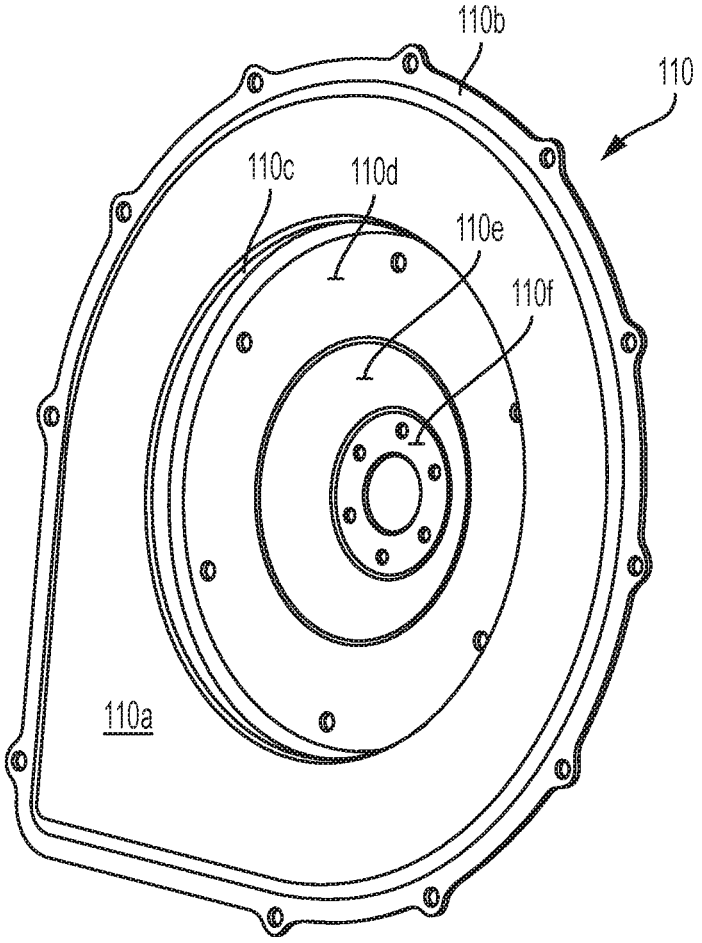
FIG. 14 is a perspective view of a cable or drum cover plate of the cover plate sub-assembly.

A cable or drum cover plate sub-assembly 100 (FIG. 13) is secured to the outer surface of the cable or drum side housing member 14 to close the housing member 14 on the cable or drum side, and to thus contain the drum assembly 80. The drum cover plate sub-assembly 100 comprises the cable or drum cover plate 110 which is shaped complimentarily to the housing member 14 to close the cable/drum side housing member 14. The drum cover plate 110 includes main, generally planar surface 110*a* having a peripheral mounting flange 110*b*. The mounting flange 110*b* defines a plurality of bolt holes positioned to be aligned with the screw holes 26*b* in the outer edge of the cable/drum side housing member, such that the screws 34 can be threaded into the screw holes 26*b* through the drum cover plate to secure the drum cover plate to the housing member 14. As seen in FIG. 13, the peripheral flange lays in a plane offset from, but parallel to, the main surface 110*a*. A sloped wall connects the peripheral flange 110*b* to the main surface 110*a*. In its approximate center, the drum cover defines an inwardly recessed, cylindrical portion defined by an axially extending wall 110*c* and a generally flat circular surface 110*d*, the surface 110*d* being generally parallel to the main surface 110*a*. The cylindrical wall 110*c* defines a diameter that is slightly smaller than the inner diameter of the generally U-shaped cable-holding portion 94 of the drum assembly 80. Further, the cylindrical wall 110*c* is sized such that the drum cover surface 110*d* is spaced only slightly outwardly of the radially extending wall of the drum cable-holding portion 94. As noted in FIG. 2, a radial direction is generally normal to the axis of the spindle 60. An annular wall 110*e* slopes inwardly to a second circular surface 110*f*. An opening 110*g* is formed in the center of the surface 110*f* through which the spindle passes. As seen in FIG. 2, the surface 110*f* is spaced only slightly from the central plate 84*a* of the drum outer portion 84.

A clutch seal bracket 112 is mounted to the outer side of the surface 110*f* (i.e., within the area defined by the sloped wall 110*e*). The clutch seal bracket comprises an annular body 112*a* and in inwardly extending annular flange 112*b*. The clutch bracket is secured to the drum cover by a series of screws which pass through the clutch bracket body into screw holes spaced about the periphery of the cover surface 110*f*. The clutch bracket 112 holds an annular clutch seal 114 in place. The clutch seal 114 is preferably a wiper seal having an inner edge which seals against the spindle 60. The clutch seal 114 will thus close the opening of the drum cover plate 110 to substantially prevent contaminants from passing through the opening.

Figure 15:
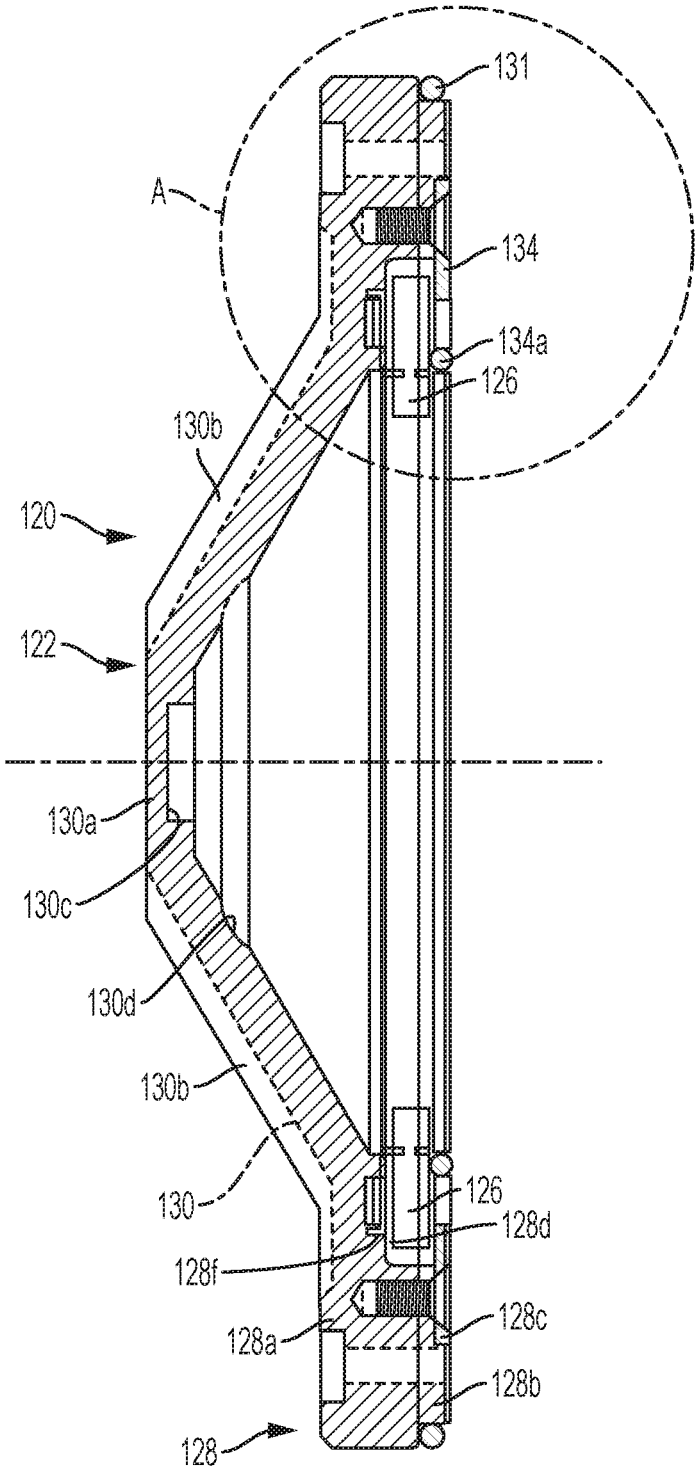
FIG. 15 is cross-sectional view of a clutch cover assembly of the sealed retractable fall arrest block.
Figure 15A:
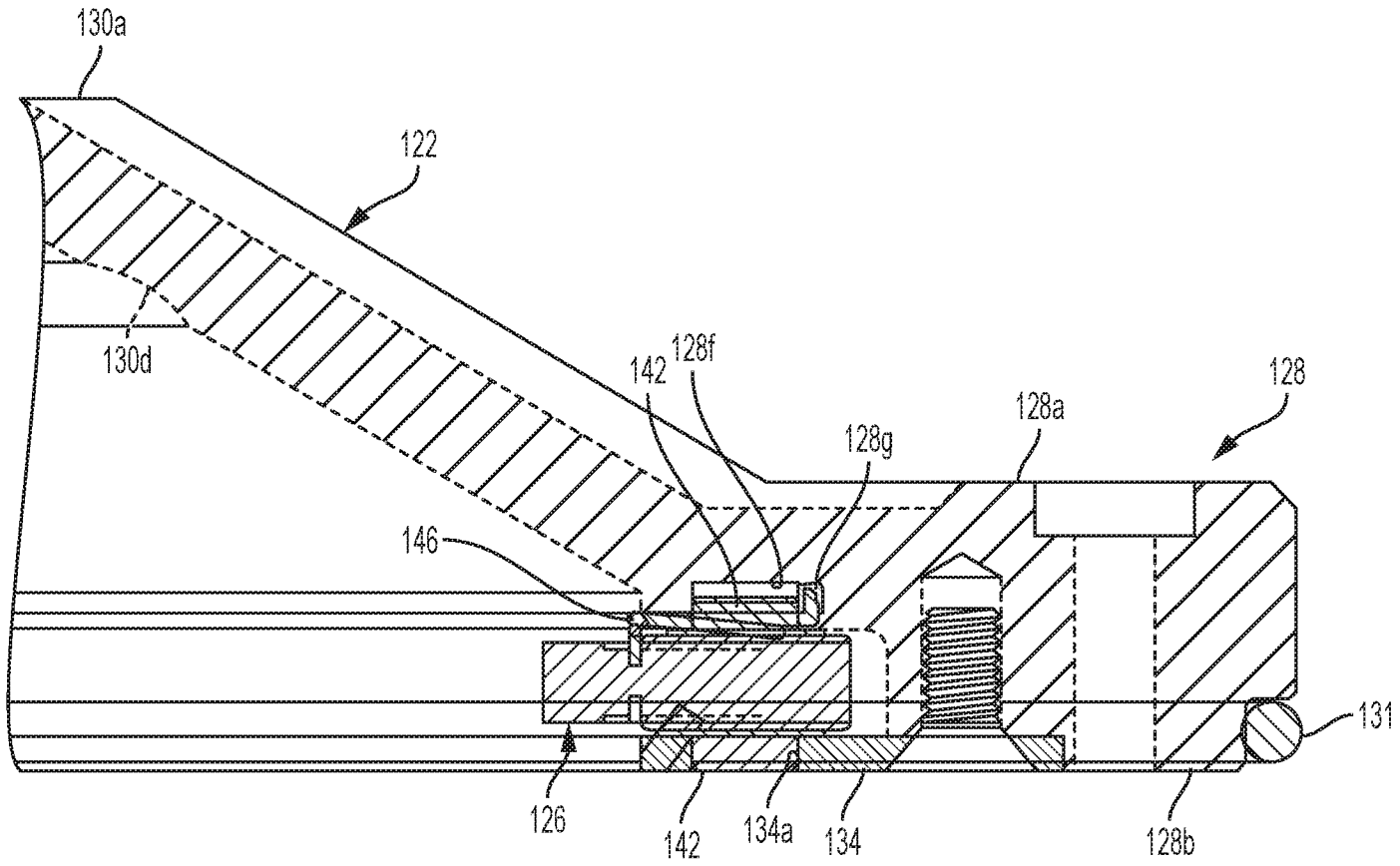
FIG. 15A is an enlarged sectional view of the clutch cover assembly taken along circle A of FIG. 15.
Figure 16A:
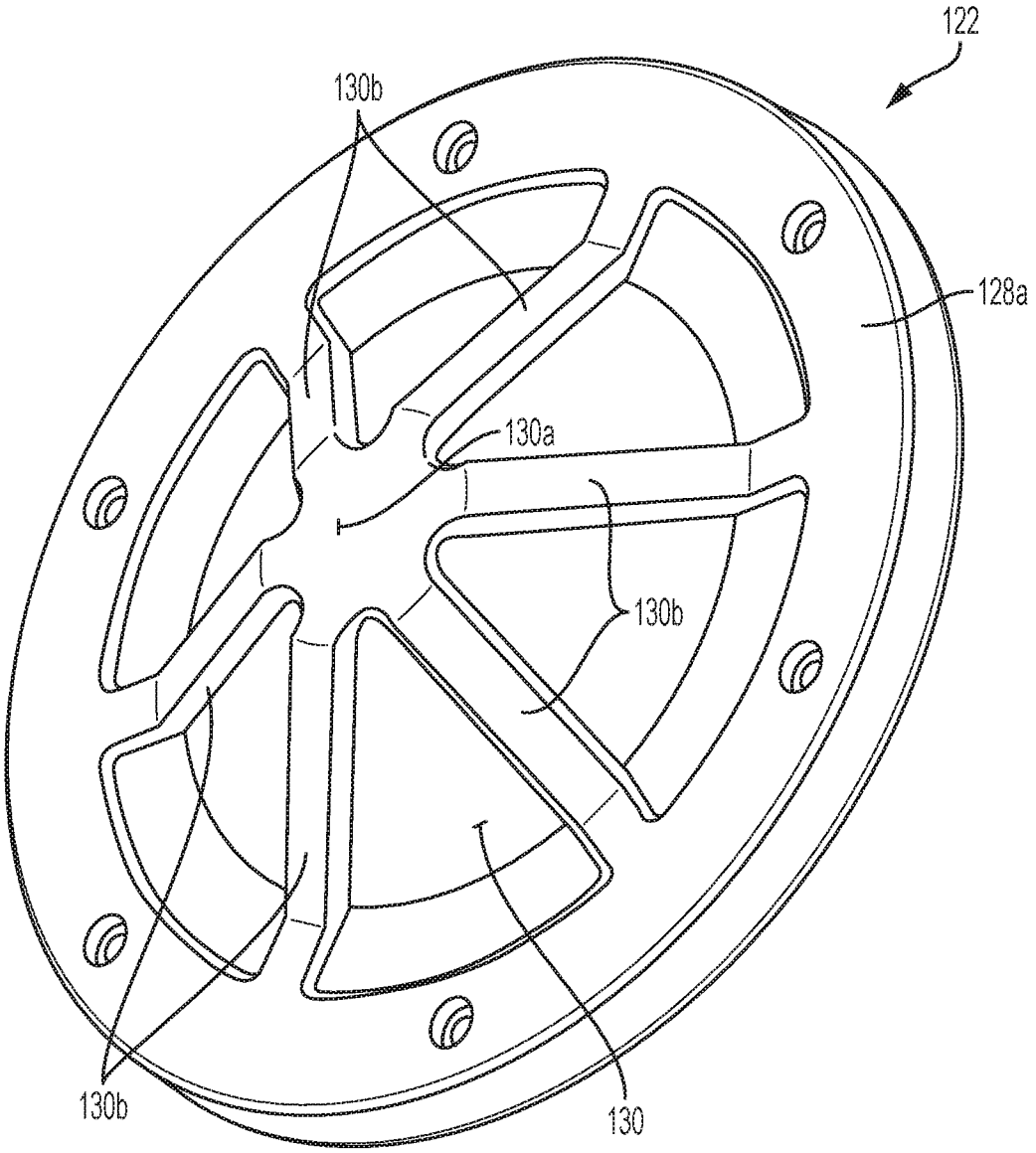
FIGS. 16A and 16B are front and back perspective views of a clutch cover of the clutch cover assembly.
Figure 16B:
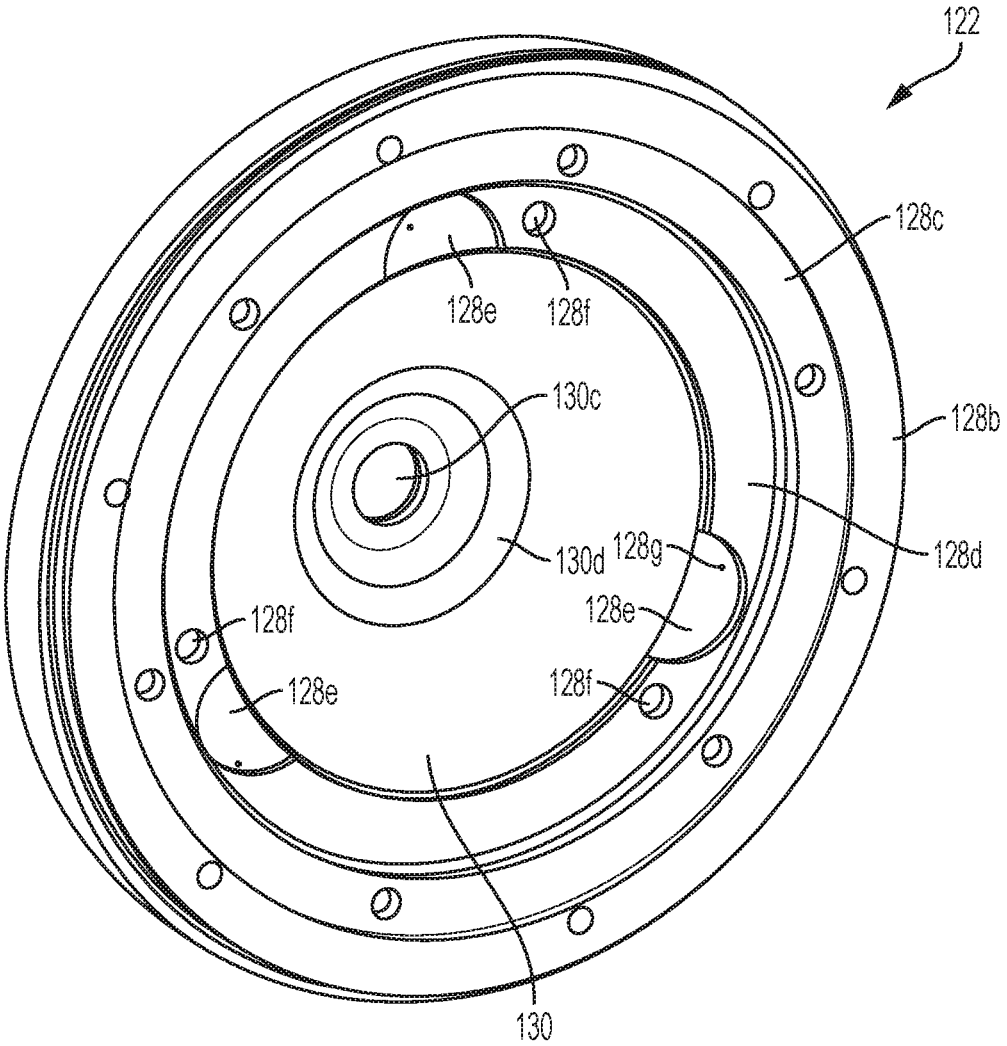
Figure 17D:
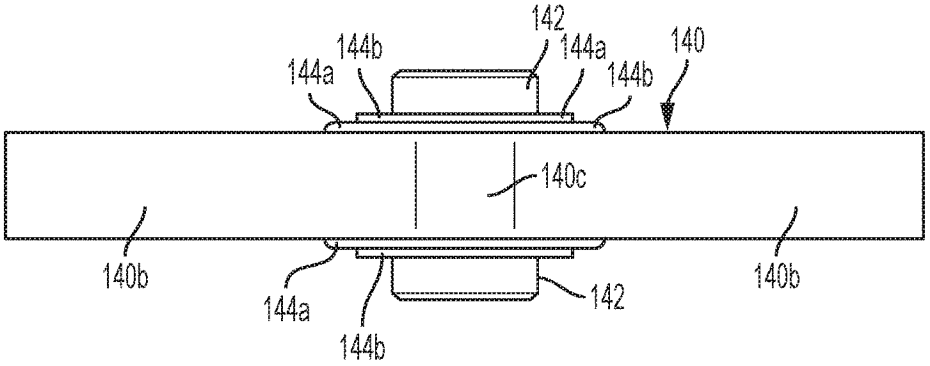
FIGS. 17A-D are perspective, face plan, side elevational, and top elevational view of a pall of the clutch cover assembly.
Figure 17B:
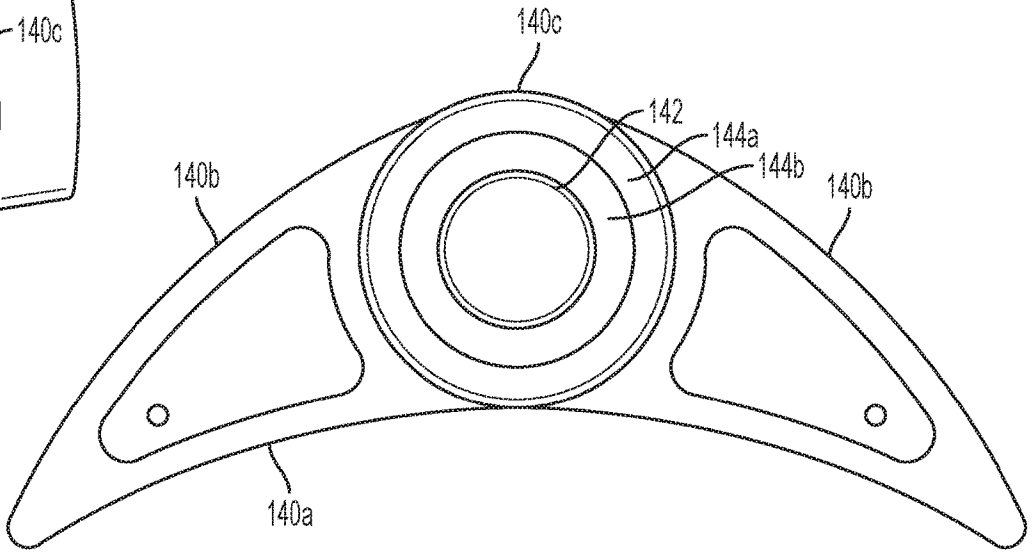
Figure 17A:
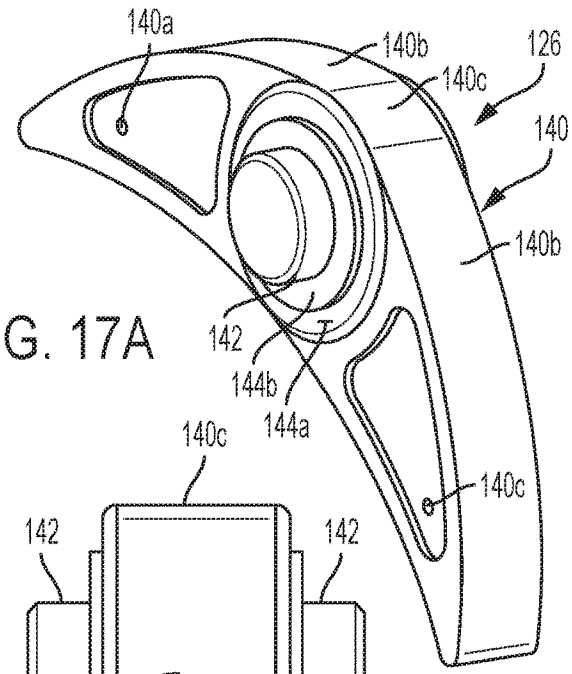
Figure 17C:
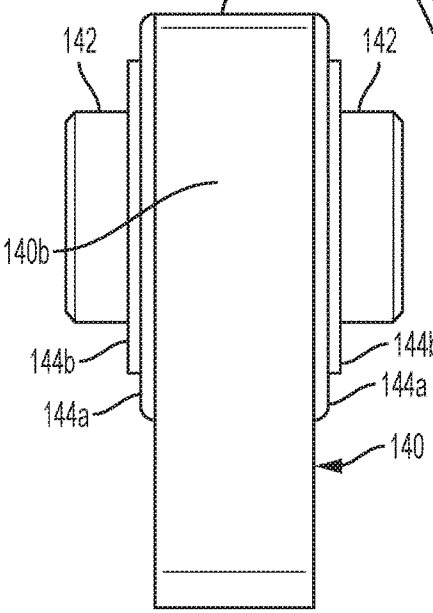

A clutch cover assembly 120 (FIGS. 15-16B) is fixed to the drum cover plate 110. The clutch cover assembly comprises a clutch cover 122, a pawl plate 134, and pawls 126. The clutch cover 122 comprises a generally annular outer ring portion 128 having an outer surface 128*a* and an inner surface 128*b*. The inner surface 128*b* is stepped inwardly from the periphery of the clutch cover 122 to define an inner seat 128*c*. A second step is formed inwardly of the seat 128*c* to define a pawl seat area 128*d*. The pawl seat area 128*d* defines three generally semicircular cutouts 128*e* and bores 128*f* proximate the cutouts 128*e*. A conical wall 130 extends upwardly from inner edge of the ring portion 128. Externally, the conical wall 130 is truncated and ends in a flat axial outer surface 130*a*. The outer surface of the wall 130 is ribbed, as at 130*b*. Internally, the conical wall 130 ends in a central bore 130*c*. A recessed channel 130*d* is formed in the inner surface of the wall 130 below the bore 130*c*.

The ring portion 128, and hence the clutch cover 122, has a diameter sized such that the clutch cover 122 can be received in the recessed portion of the drum cover plate 110, as seen in FIG. 2. An O-ring 131 sits in an outer seat formed in the inner surface 128*b* of the ring portion 128. The O-ring 131 forms a seal between the clutch cover 122 and the drum cover plate 110 (and in particular with the wall 110*c* and surface 110*d* of the cover plate 110). The clutch cover 122 is secured to the drum cover plate 110 by means of screws which extend through screw holes in the clutch cover ring portion 128 and into aligned screw holes in the surface 110*d* of the drum cover plate 110. When the clutch cover 122 is secured to the drum cover 110, the two, in combination, define a clutch/pawl housing 132. As seen in FIG. 2, the bore 130*c* of the clutch cover is sized to receive the end of the spindle 60.

As can be seen in FIG. 2, the clutch housing 132 is sealed from the drum by the seal 114, and the bearing housing 52 is sealed from the drum by the seal 76. The use of the two wiper seals on opposite sides of the drum housing portion of the cable side housing member 14 prevent dirt, grime, liquid and other contaminants from entering the bearing housing 52 and clutch housing 132 from the drum housing. This also enables both the clutch and the springs to run in an oil bath because the seals substantially prevent oil from leaking out during use. By running the clutch and the springs in an oil bath, the clutch components and springs can be made of carbon steel, rather than stainless steel because the oil naturally prevents galvanic corrosion.

Returning to FIG. 15, the clutch cover assembly 120 further includes a pawl plate 134 which is in the form of a ring or annular plate. The pawl plate is received in the seat 128*c* of the clutch cover 122 by means of screws which pass through the pawl plate 134 into screw holes in the clutch cover seat 128*c*. The pawl plate extends over the pawl seat 128*d*, and a plurality of pawls 126 are held in place between the pawl plate 134 and the pawl seat 128*d*. The pawl plate 134 includes a plurality of openings 134*a* that are aligned with the bores 128*f* in the pawl seat 128*d*.

A pawl 126 is shown generally in FIGS. 17A-D. The pawl 126 comprises a body 140 having an inner edge 140*a* which defines a radius and an arc of about 65° to about 70°. First and second outer edges 140*b* extend toward each other from the ends of the inner surface to meet at a curved apex 140*c*. The outer edges also are radiused (albeit with a different radius than the inner edge 140*a*), and each outer edge 140*b* defines an arc of about 65° to about 70°. Thus, the pawl body 140 has a generally triangular appearance, but with outwardly arced (convex) side edges (or legs) and an inwardly arced (concave) bottom edge (or base). Opposed posts 142 extend from the top and bottom surfaces of the pawl body. The posts 142 are sized to be received in the bores 128*f* of the clutch cover 122 and in the openings 134*a* in the pawl plate 132. The posts 142 are each surrounded by concentric platforms 144*a,b* The platforms are concentric with each other and with the posts 142, and function to space the body 140 of the pawl 126 from the both the inner surface of the clutch cover and the pawl plate so as to reduce friction. This will allow the pawl to pivot more freely in the clutch cover bore 128*f* and the pawl plate 134*a*.

Lastly, the clutch cover assembly 120 includes a spring 146 (FIG. 19) associated with each pawl 126. The spring is preferably a torsion spring having a first end received in a bore 140*c* in the surface of the pawl and a second end received in a bore 128*g* of the clutch cover plate. The body or coil of the torsion spring is received in the cutout 128*e* of the clutch cover plate, and the spring hole 128*g* is positioned within the cutout proximate the edge of the cutout. The spring is essentially a push spring, rather than a pull spring. A push spring moves the pawl to an almost overcenter position at maximum pawl rotational travel. This means that on lockup, if rebound occurs, the pawl will dwell momentarily in the locked position to prevent ratcheting or repeated locking and unlocking of the clutch mechanism, as described in our Pub. No. US20160346572, the entirety of which is incorporated herein by reference.

Figure 18B:
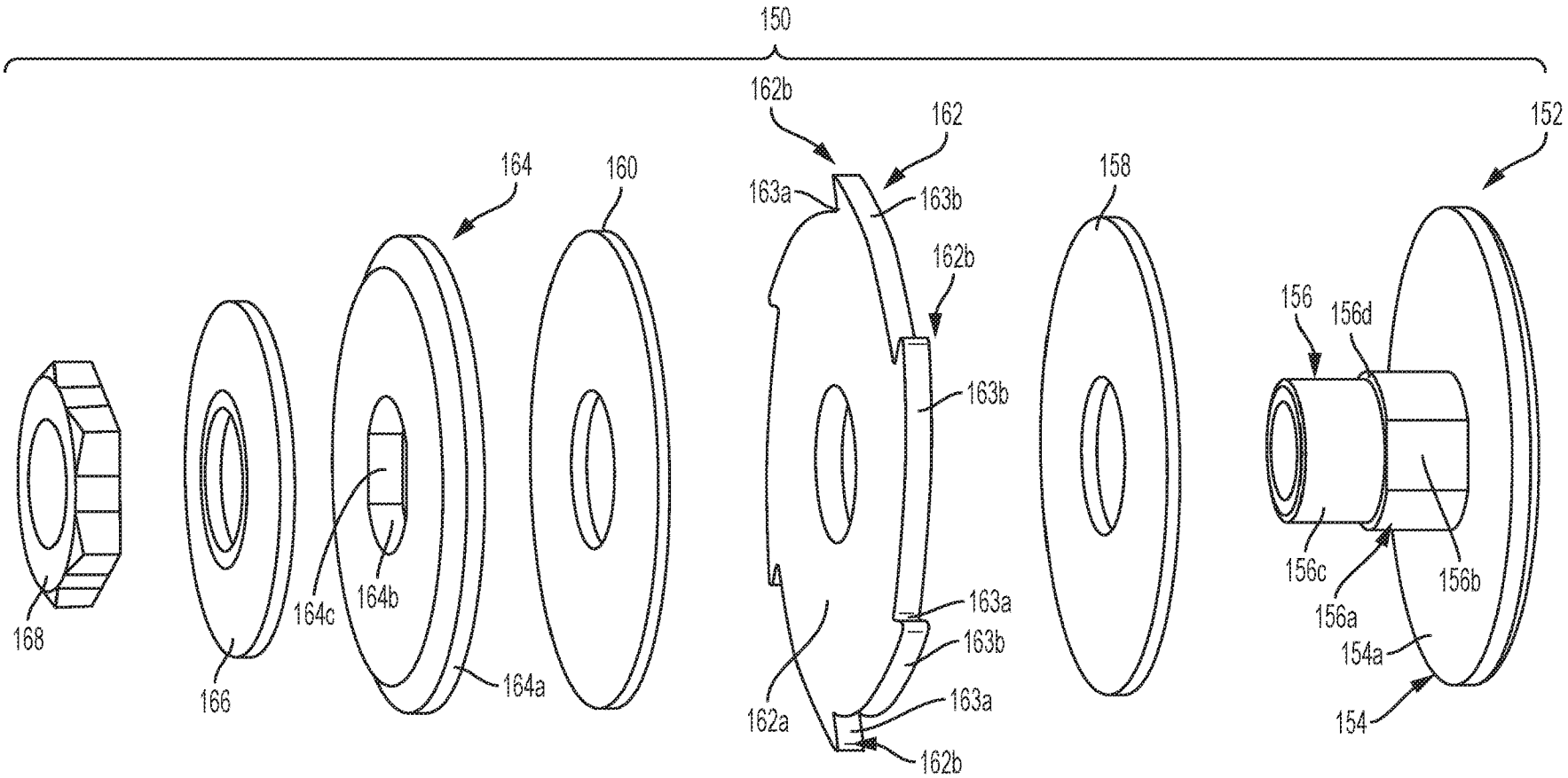
FIGS. 18A and 18B are cross-sectional and perspective exploded views, respectively, of a clutch assembly of the sealed retractable fall arrest block.
Figure 18A:
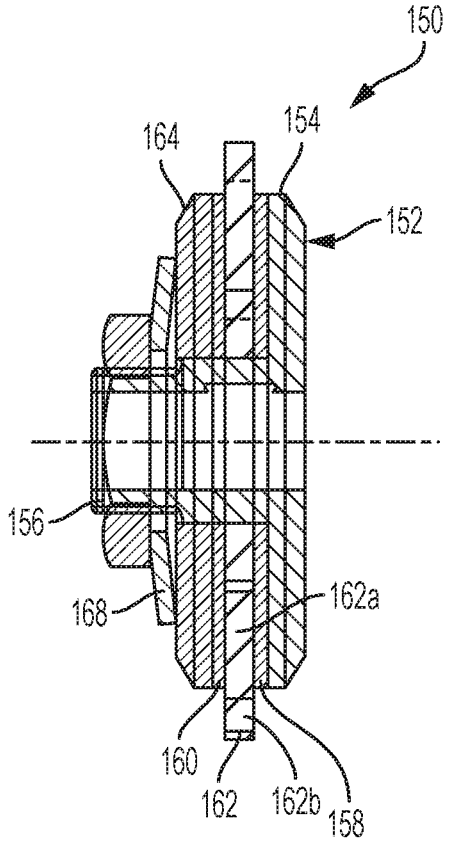

A clutch assembly 150 (FIGS. 18A, B) is received in the clutch housing 132 defined by the drum cover plate 110 and the clutch cover 122. The clutch assembly 150 comprises a rear pressure plate 152 which is received on the spindle 60. The pressure plate 152 comprises a circular plate 154 having a flat outer surface 154*a*. A post 156 extends outwardly from the center of the surface 154*a*. The post 156 is hollow so that it can be received over the spindle 60. The post 156 includes a first portion 156*a* which extends from the plate 154 and has opposed flat faces 156*b*, but is otherwise generally cylindrical. A cylindrical second post portion 156*c* extends from the end of the first post portion 156*a*, and has an outer diameter that is smaller than the outer diameter of the first portion, such that a shoulder 156*d* is defined at the junction between the first and second portions of the post. The pressure plate 152 is rotationally fixed relative to the spindle to rotate with the spindle. For example, the pressure plate 152 can include an axially extending groove along the inner surface of the post 156 which engages a rib, spline, or keyway on the spindle 60. Alternatively, the spindle can have a groove which receives a rib or spline on the post inner surface. As another alternative, the spline and inner surface of the pressure plate post can have engaged or mating flat surfaces (i.e., the two parts can be provided with flats in an otherwise cylindrical surface, or the two parts can have polygonal sections which engage each other). As a further alternative, a pin could extend through the pressure plate post into the spindle. The pressure plate can be rotationally fixed to the spindle in any other desired manner.

First and second friction disks 158 and 160 sandwich a sperrad 162. The first friction disk 158 abuts the pressure plate surface 154*a*; the sperrad 162 abuts or is in contact with the first friction disk 158; and the second friction disk 160 is on an opposite side of the sperrad 162 from the first friction disk 158. The friction disks have a diameter approximately equal to the diameter of the pressure plate, and are made from a low coefficient frictional brake friction material. The sperrad 162 has a body portion 162*a* that is also about the size of the pressure plate 152 and friction disks 158, 160. A plurality of teeth 162*b* extends from the sperrad body portion 162*a*. Each tooth 162*b* has a leading surface 163*a* that is generally flat and a trailing surface 163*b* that defines an arc extending from the outer end of the leading edge to the base of the leading edge of the preceding tooth 162*b*. The friction disks 158, 160 and the sperrad 162 are all received on the post first section 156*b* of the rear pressure plate 152.

A front pressure plate 164 is received about the post first section 156*b* of the rear pressure plate 152 and has a flat surface 164*a* that is positioned against the second friction plate 160. The front pressure plate 164 has a central opening 164*b* having opposed flats 164*c* which mate with the flats 156*b* of the rear pressure plate post 156. The front pressure plate 164 thus rotates with the rear pressure plate 156.

A Belleville washer 166 is positioned on the rear pressure plate's second post portion 156*c* against the front pressure plate, and a nut 168 is received on the end of the rear pressure plate's post second portion 156*c* to hold the friction disks, sperrad, front pressure plate and washer on the post 156 of the rear pressure plate 154. The nut, when tightened against the spindle nut will clamp the sperrad 162 between the first and second friction plates 158, 160 and between the rear and front pressure plates 154, 164. Thus, the sperrad 162 will rotate with the spindle 60 as the spindle is rotated by unwinding of the cable from the drum.

Figure 19:
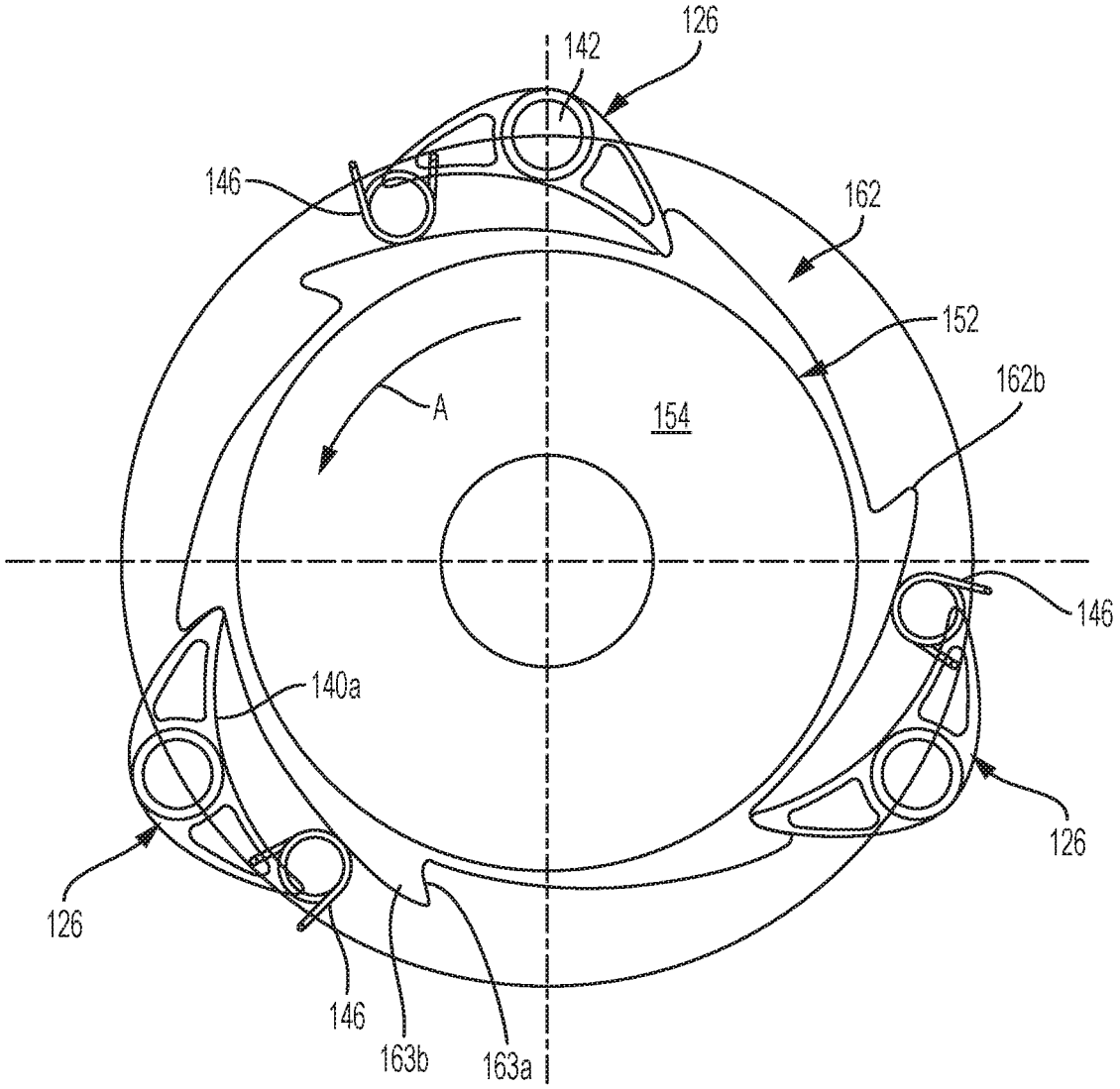
FIG. 19 is a plan view showing the pawls engaging the teeth of the sperrad in the clutch assembly.
Figure 20A:
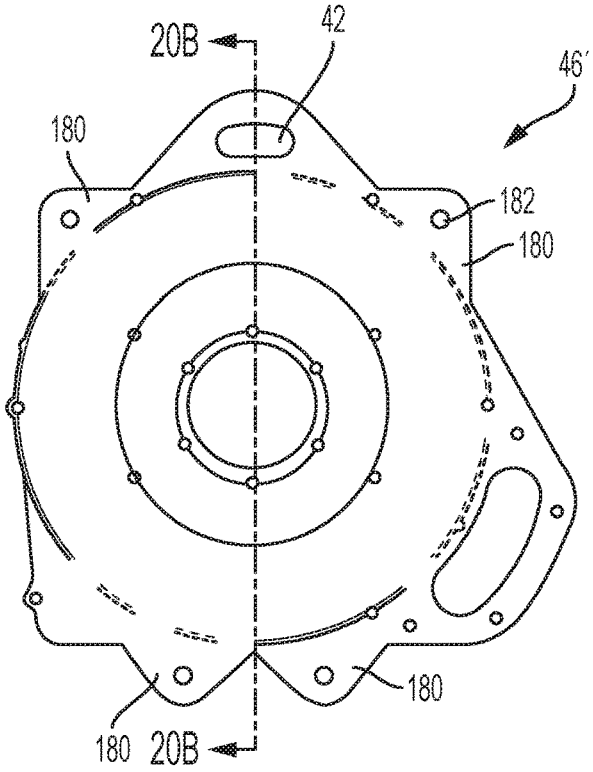
FIGS. 20A and 20B are a plan and cross-sectional views of a modified center mounting plate provided with lobes which allow for the retractable to be mounted to a wall.
Figure 20B:
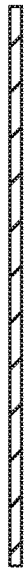
Figure 20C:
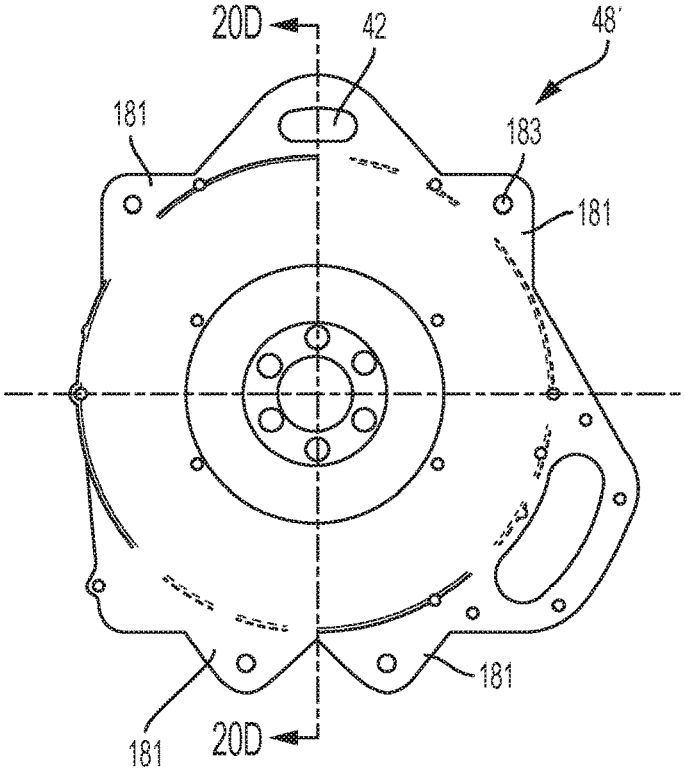
FIGS. 20C and 20D are a plan and cross-sectional views of a modified center wiper plate provided with lobes which allow for the retractable to be mounted to a wall.
Figure 20D:
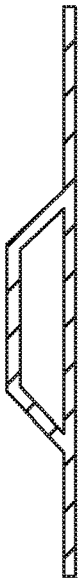

A plan view of the engagement between the pawls 126 and the sperrad teeth 162*b* is shown in FIG. 19. The operation of the clutch is described in Pub. No. US20160346572, the entirety of which is incorporated herein by reference. As described therein, the torsion springs 146 operate to positively push (rather than pull) a cam tip of the pawl (the end of the pawl facing away from the sperrad teeth) into engagement with the surface of the sperrad. Because the spring 146 biases the cam or trailing end of the pawl against the edge of the sperrad 162, the inner edges 140*a* of the pawls face generally towards the sperrad teeth 220. Thus, as the sperrad 162 rotates in the direction A, the sperrad teeth 162*b* will engage the inner edge 140*a* of the pawl. As the sperrad 162 continues to rotate, the sperrad teeth 162*a* will push against the inner edge 140*a* of the pawl, causing the pawl 140 to pivot about its posts 142. This will push the cam/trailing end of the pawl away from an engagement zone of the sperrad (defined by the radius of the sperrad teeth) and cause the engagement/leading tip of the sperrad to enter the engagement zone. As the sperrad tooth 162*a* passes beyond the pawl 126, the spring 146 will force the cam/trailing end of the pawl against the edge of the sperrad, bringing the engagement/leading tip of the pawl out of the engagement zone of the sperrad.

Under normal (non-emergency) operation, the rotation of the sperrad is relatively slow, and the position and strength of the spring 146 is selected such that the spring will pivot the engagement tip of the pawl out of the engagement zone before the oncoming sperrad tooth 162*a* engages the pawl engagement tip. However, during a fall, the rate of rotation of the sperrad 162 exceeds the rate at which the spring 146 pushes against the pawl, and at least one sperrad tooth 162*a* will engage the engagement tip of at least one of the pawls 126 before the spring 146 can bias the engagement tip of the pawl out of the sperrad's engagement zone. When a sperrad tooth and the pawl are engaged in this manner, rotation of the spindle (and thus rotation of the drum) is prevented. Thus, once the sperrad and pawl are engage, the cable is prevented from unwinding from the drum.

Returning to FIG. 2, a coiled spring 170 is received in the spring housing member 16. The spring 170 can, for example, be made from stainless spring steel or textured rolled carbon steel. For a 130' retractable, the spring 170, when unwound, is sufficiently long to wrap (or define) fifty-five or more drum revolutions. The spring for a 175 ft. retractable will need to be sufficiently long to wrap at least seventy-five revolutions of the drum. The spring 170 is fixed at an inner end to the spindle 60. For example, the spindle can include an axially extending slot, and the inner end of the spring can then be received in this slot. The spring 170 is also fixed, at an outer end of the spring, to the housing. For example, the outer end of the spring can be received in the gap between the housing straight wall 15*c* and the inwardly extending projection 17 (FIG. 4C). The mounting and positioning of the spring 170 in the spring housing causes the spring to wind about the spindle as the cable is unwound from the drum. When tension on the cable is relaxed, the spring 170 will cause the spindle to rotate in an opposite direction, thereby causing the cable to be retracted into the cable housing and around the drum.

As noted, the cable side and spring side housing members 14 and 16 are mounted to the center support wall 18 and are closed by their respective plates 110 and 23. To further ensure that the housings are sealed, gaskets can be positioned between the outer edges of the housings and their respective plates. In addition, gaskets can be positioned between the inner edges of the housing members and the center support wall 18.

The retractable 10 has several benefits. First, the spindle 60 is mounted to the center support wall 18, and the clutch assembly 150, the drum assembly 80, and the return spring 170 are all mounted to the spindle 60. Further, the spindle is fully supported by the center support wall 18, and neither the spring housing cover 23 nor the clutch cover 122 support the spindle. Thus, all forces are borne by the center support wall. Therefore, in a fall, the housing members 14, 16 will be subject to only slight torsion loads due to the clutch housing resisting moments. This allows for the housing members to be made of a lighter material to reduce the overall weight of the retractable.

Additionally, the retractable is comprised of assemblies—the clutch cover assembly, the clutch assembly, the drum assembly, and the spindle/bearing assembly. This allows for easy assembly of the retractable and easy disassembly of the retractable should replacement or service of the various assemblies be necessary. As noted above, the components are formed as assemblies and the entire workings of the block 10 can be easily accessed, thus facilitating replacement of worn, damaged, or non-functioning parts. The clutch assembly 150 can be easily accessed by removing the screws that hold the clutch cover 122 to the cable housing plate 110. The drum assembly 80 is accessed by removing the screws 34 which hold the cable housing cover 110 to the cable side housing member 16. Finally, removing the bolts 32 that hold the spring side cover 23 to the spring side housing member 16 allows for disassembly of the complete retractable from the spring side. To assemble the sealed retractable, the spindle/bearing assembly is mounted to the center mount plate 46 of the center support wall 18, and the center wiper plate 48 is then secured to the bearing holder 54 and to the center mount plate 46. The return spring 170 is connected between the spindle 60 and spring side housing member 16. The housing members 14 and 16 are then connected to the center support wall (after the spring side cover plate is positioned on the spring side housing member) by means of the bolts 32 which extend through the spring side housing member into the cable side housing member. On the cable side, the drum assembly is positioned on the spindle so that it is keyed to the spindle, and the cable is threaded through the nozzle. The cable side cover plate (with the clutch side seal 114) is secured to the cable housing member 14. The clutch assembly 150 is then positioned on the spindle. Finally, the clutch cover (with the pawls and pawl plate) is secured to the cable side cover plate so that the pawls are co-planar with the sperrad.

Further, because the components are mounted to a cantilevered main shaft or spindle that is supported by a central rib or wall, all component sub-assemblies can be stocked by the customer and replaced in the field, greatly reducing cost and down time. Only the individual components and sub-assemblies are then required to be returned to the factory for service.

The bearing seal 76 and the clutch seal 114, which preferably are wiper seals, effectively seal the drum housing from both the bearing housing 52 and the clutch housing 132. As is known, during use, dirt, water, ice and other contaminants that could foul or otherwise interfere with or impede the function of either the bearings 58*a,b* or the clutch assembly enter the drum housing. The seals 76 and 114 substantially prevent these elements from passing into either the bearing housing or the clutch housing from the drum housing, to thereby increase the useful life of the retractable. Although wiper seals are preferred, other types of seals could be used. For example, either (or both of) the clutch seal 114 and bearing seal 76 could be replaced, for example, with O-rings or labyrinth seals. As noted above, because the clutch and spring assemblies are sealed, they can be operated in oil baths, which allows for the components of the clutch and spring assembly to be made from carbon steel.

The screws which hold the cover plates to the housing members are steel, whereas the housing members are made of aluminum. This difference in metals can result in galvanic corrosion, in this instance, of the aluminum housing members. To control this galvanic corrosion, sacrificial anodes are placed in the screw holes for the screws/bolts 32, 34 which secure the cover plates 110 and 23 to the housing members. The sacrificial anodes are sized to ensure that they are in contact with the aluminum part which the anodes are to protect. Additionally, the length of the anodes is such that they will not interfere with bolt assembly of the retractable. These anodes are made of a material that has a higher oxidation potential than aluminum. In this embodiment, the preferred material is pure zinc wire.

Additionally, as noted above, the housing members are (prior to post formation finishing) identical in cross-section, and can be formed by an extrusion procedure. First, this makes production of the housing members relatively easy. Additionally, it allows use of the same extrusion mold to form retractables of varying sizes. A longer or shorter retractable can be made by increasing or decreasing the axial length of the housing members.

FIGS. 20A-D shows an alternate center mounting plate 46' and an alternate center wiping plate 48' for the structural center support wall. The plates 46' and 48' are substantially identical to their corresponding plates 46 and 48. However, the plates 46' and 48' are provided with lobes 180 and 181, respectively which extend from the periphery of the plates 46', 48'. Each lobe 180, 181 defines a bolt hole 182, 183, respectively. The plates 46' and 48' are sized such that when placed adjacent each other, the lobes 180, 181 and their respective holes 182, 183 are aligned. The plates 46', 48' are shown to have four lobes 180, 181: one on each side of the portion which defines the clip attachment hole 42, and two positioned adjacent each other on a side of the plates 46', 48' opposite the first two lobes.

Figure 21A:
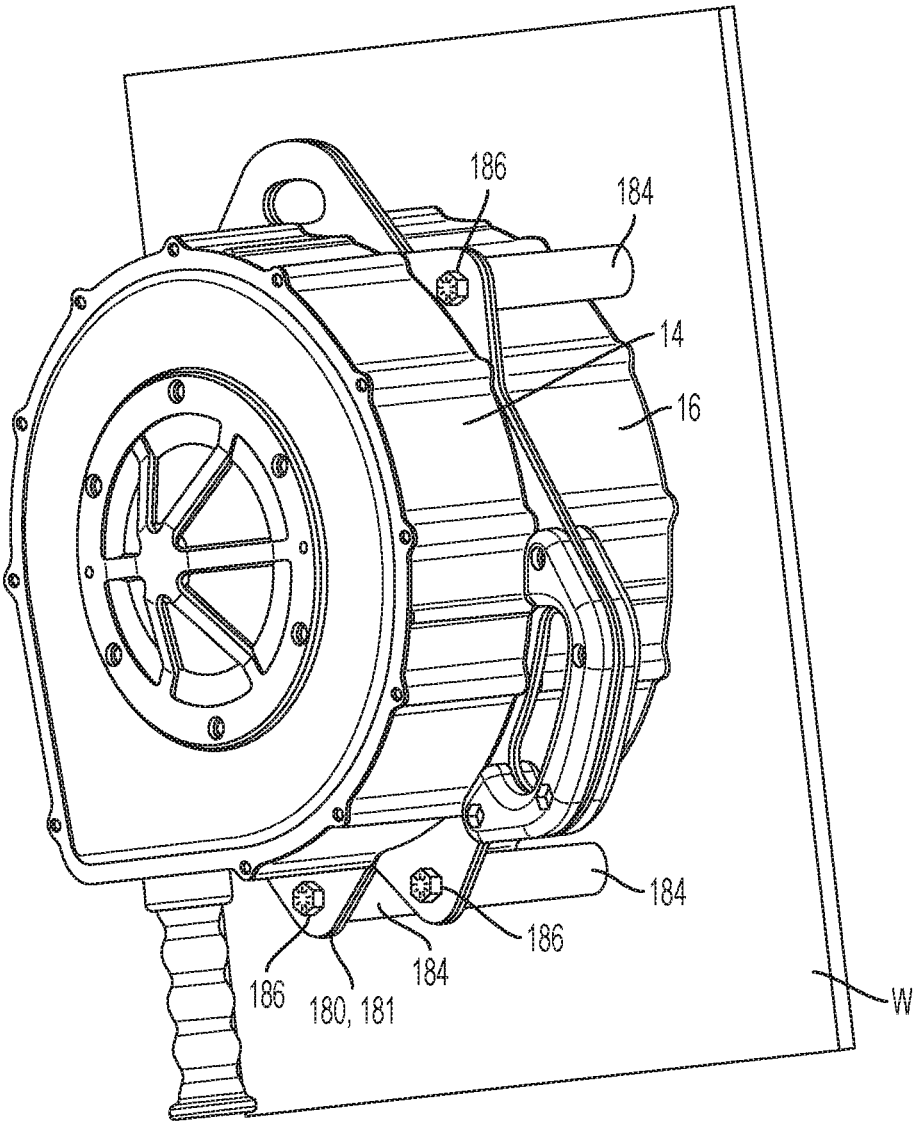
FIGS. 21A and 21B are perspective and side elevational views, respectively, of a sealed retractable fall arrest block including the center support wall plate of FIG. 20 and mounted to a wall.
Figure 21B:
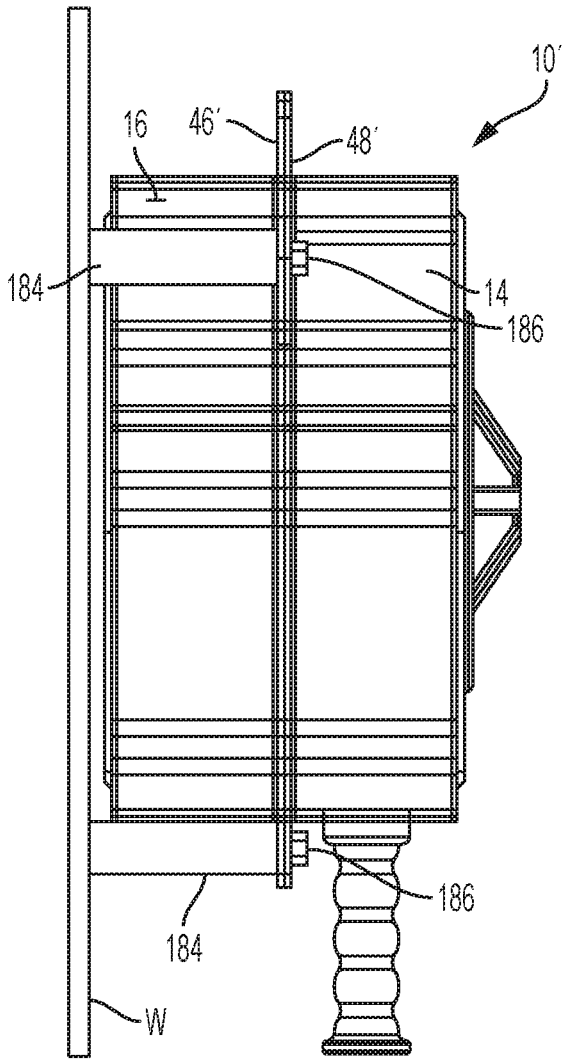

FIGS. 21A, B show a retractable 10' which utilizes the center support wall plates 46' and 48'. As seen, the lobes 180, 181 extend from the walls of the retractable housing members 14, 16. This allows for mounting of the retractable to a surface, such as a wall W, using standoffs 184 which extend perpendicularly from the wall W. The standoffs 184 include threaded bores at least at the ends of the standoffs remote from the wall W. Bolts 186 pass through the lobes 180, 181 of the plates 46', 48' into the standoffs 148 to mount the retractable to the wall W. Although the retractable 10' is provided with four wall mounting lobes, it will be appreciated that more or fewer lobes could be provided. However, to prevent rotation of the retractable relative to the wall, the retractable 10' would need to have at least two, and preferably at least three, wall mounting lobes.

As various changes could be made in the above constructions without departing from the scope of the invention, it is intended that all matter contained in the above description or shown in the accompanying drawings shall be interpreted as illustrative and not in a limiting sense. For example, at least a portion of flat peripheral areas of the center mounting plate 46 and the center wiper plate 48 could be formed as spokes or ribs; or, the center mounting plate 46 and the center wiper plate 48 could be formed as spokes extending radially from a central ring. In either case, the overall weight of the structural center support wall would be reduced. However, this construction would rely more heavily on the center gasket 50 to separate the areas defined by the cable and spring side housing members. The bearing and clutch wiper seals 76 and 114 could, for example, be replaced with O-ring seals, labyrinth seals, or other types of seals which would prevent contaminants from entering the bearing housing and clutch housing from the drum housing without substantially interfering with rotation of the spindle. The cable 90 can be secured to the drum 80 in any conventional manner which will prevent separation of the cable from the drum when subject to tension forces. These examples are merely illustrative.

The invention claimed is:

1. A retractable fall arrest block comprising:

a structural center support wall;

a bearing assembly mounted to said structural center support wall;

a spindle rotatably supported by said bearing assembly; said spindle comprising a spring side portion extending from a spring side of said structural center support wall and a drum side portion extending from a drum side of said structural center support wall;

a spring side housing member on a spring side of said structural center support wall and a spring side cover plate mounted to an end surface of said spring side housing member opposite said structural center support wall; said spring side housing member, said spring side plate, and said structural center support wall, in combination, defining a spring housing;

a return spring mounted in said spring housing; said return spring being connected at a first end to said spindle and positionally fixed at a second end to said housing to cause rotation of said spindle in a winding direction after said spindle has been rotated in an unwinding direction;

a drum side housing member on a drum side of said structural center support wall; a drum side cover plate mounted to an end surface of said drum side housing member opposite said structural center support wall; said drum side cover plate, said drum side housing member and said structural center support wall, in combination, defining a drum housing; said drum side portion of said spindle extending at least into said drum housing;

a drum mounted to said spindle and rotatably fixed to said spindle, such that said drum and said spindle rotate together; said drum having a cable wound thereon; said drum being rotatable in an unwinding direction in which the cable can be unwound from said drum and a winding direction in which the cable is wound onto said drum; and a clutch assembly mounted to said spindle; said clutch assembly being operable to stop said drum from rotating in said unwinding direction;

whereby neither said drum side cover nor said spring side cover include bearing assemblies that provide support for said spindle, such that substantially only said structural center support wall supports said spindle, and such that said central wall will bear substantially all the forces from the fall; and including a clutch housing separate from said drum housing and into which said spindle extends and in which said clutch assembly is contained; said clutch housing comprising said drum side cover plate and a clutch cover which is secured to said drum side cover plate; said retractable fall arrest further including a clutch housing sealed which separates said drum housing from said clutch housing to substantially prevent contaminants from entering said clutch housing from said drum housing.

2. The retractable fall arrest block of claim 1 wherein, the structural center support wall comprises at least two lobes which extend away from the walls of said housing members; said lobes being adapted to enable mounting of the retractable to a surface.

3. The retractable fall arrest block of claim 1 wherein, said clutch housing seal is a wiper seal which surrounds said spindle.

4. The retractable fall arrest block of claim 1 wherein, said spring side cover plate and said drum side cover plate are secured to said housing members by means of fasteners which extend into fastener holes in said housing members; wherein said fasteners and said housing members are made from different metals; said retractable fall arrest block further including a sacrificial anode associated with each fastener to provide cathodic protection to at least reduce the oxidation of the housing members, cover plates and fasteners.

5. The retractable fall arrest block of claim 1 wherein, except for finishing operations to said housing members, said spring side housing member and said drum side housing member are substantially identical.

6. The retractable fall arrest block of claim 5 wherein, said housing members are extruded from a light weight material.

7. The retractable fall arrest block of claim 6 wherein, the housing members are made from a light weight metal or a plastic.

8. The retractable fall arrest block of claim 1 wherein, said structural center support wall defines an opening external of said housing adapted to receive a connector to operatively connect said housing to a support structure during use of said retractable fall arrest block.

9. A retractable fall arrest block comprising:

a structural center support wall comprising a center mount plate and a front center plate; said center mount plate and front center plate, in combination, defining a bearing housing;

a bearing assembly mounted to at least one of said center mount plate and said front center plate inside of said bearing housing;

a spindle rotatably supported by said bearing assembly; said spindle comprising a spring side portion extending from a spring side of said structural center support wall and a drum side portion extending from a drum side of said structural center support wall;

a spring side housing member mounted to a spring side of said structural center support wall and a spring side cover plate mounted to an end surface of said spring side housing member opposite said structural center support wall; said spring side housing member, said spring side plate, and said structural center support wall, in combination, defining a spring housing;

a return spring mounted in said spring housing; said return spring being connected at a first end to said spindle and positionally fixed at a second end to said housing to cause rotation of said spindle in a winding direction after said spindle has been rotated in an unwinding direction;

a drum side housing member mounted to a drum side of said structural center support wall; a drum side cover plate mounted to an end surface of said drum side housing member opposite said structural center support wall; said drum side cover plate, said drum side housing member and said structural center support wall, in combination, defining a drum housing; said drum side portion of said spindle extending at least into said drum housing;

a drum mounted to said spindle and rotatably fixed to said spindle, such that said drum and said spindle rotate together; said drum having a cable wound thereon; said drum being rotatable in an unwinding direction in which the cable can be unwound from said drum and a winding direction in which the cable is wound onto said drum; and a clutch assembly mounted to said spindle; said clutch assembly being operable to stop said drum from rotating in said unwinding direction;

whereby neither said drum side cover nor said spring side cover include bearing assemblies to support said spindle, such that substantially only said structural center support wall supports said spindle, and such that said central wall will bear substantially all the forces from a fall.

10. The retractable fall arrest block of claim 9 including a seal which seals said bearing housing from said drum housing to substantially prevent contaminants from entering said bearing housing from said drum housing.

11. The retractable fall arrest block of claim 10 wherein, said seal is a wiper seal which surrounds said spindle.

* * * * *